US007469979B2

(12) United States Patent
Tupper et al.

(10) Patent No.: US 7,469,979 B2
(45) Date of Patent: Dec. 30, 2008

(54) PEDESTAL SYSTEM

(75) Inventors: Paul L. Tupper, Grand Rapids, MI (US); Peter J. Battey, Kentwood, MI (US); John Hanna J. Hasbany, Grand Rapids, MI (US); Marcus J. Cole, Grand Rapids, MI (US); Theodore M. Haan, Byron Center, MI (US); Bruce W. DuVall, Jr., Wayland, MI (US); John L. McCrackin, Grand Rapids, MI (US); Nancy A. Funk, Grand Rapids, MI (US); David J. Battey, Caledonia, MI (US); Angela Simon, Pewamo, MI (US)

(73) Assignee: Steelcase Inc., Grand Rapids, MI (US)

( * ) Notice: Subject to any disclaimer, the term of this patent is extended or adjusted under 35 U.S.C. 154(b) by 742 days.

(21) Appl. No.: 10/804,717

(22) Filed: Mar. 19, 2004
(Under 37 CFR 1.47)

(65) Prior Publication Data

US 2005/0204646 A1 Sep. 22, 2005

(51) Int. Cl.
*A47B 88/00* (2006.01)

(52) U.S. Cl. ..... 312/348.4; 312/348.1; 312/330.1

(58) Field of Classification Search ..... 312/330.1, 312/348.1, 348.2, 348.4, 215, 216, 217, 219, 312/220, 221
See application file for complete search history.

(56) References Cited

U.S. PATENT DOCUMENTS

| | | | | |
|---|---|---|---|---|
| 960,833 | A | | 6/1910 | Crum |
| 1,136,071 | A | | 4/1915 | Weiss |
| 1,172,189 | A | | 2/1916 | Bauer |
| 1,222,451 | A | * | 4/1917 | Ohnstrand ..... 312/348.4 |
| 1,352,002 | A | | 9/1920 | Jones |
| 1,649,805 | A | | 11/1927 | Brainard |
| 1,757,293 | A | | 5/1930 | Card et al. |
| 1,770,836 | A | | 7/1930 | Boote |
| 1,906,191 | A | | 4/1933 | Thomas et al. |
| 1,933,932 | A | | 11/1933 | Reinhard |
| 2,020,373 | A | | 11/1935 | Petzold, Jr. |
| 2,663,449 | A | | 12/1953 | Smart |

(Continued)

FOREIGN PATENT DOCUMENTS

EP 0 058 535 8/1982

(Continued)

*Primary Examiner*—James O Hansen
(74) *Attorney, Agent, or Firm*—Price, Heneveld, Cooper, DeWitt & Litton, LLP

(57) ABSTRACT

A pedestal system includes a cabinet having a bottom wall, a top wall, a pair of sidewalls, and a rear wall that cooperate to define a forwardly-opening aperture that slidably receives a plurality of drawer assemblies therein. The pedestal system further includes interchangeable face plates for covering the drawer assemblies, an attachment system for attaching a drawer lock/interlock assembly that locks the drawer assemblies in a closed position and prevents multiple drawer assemblies from being simultaneously opened, and a drawer divider for segmenting an interior space of each drawer assembly. The drawer lock/interlock system includes a cam assembly that allows a constant force to be applied to each drawer assembly while opening each drawer and activating the lock/interlock assembly. The pedestal system further includes an attachment system for attaching the pedestal system to a free-standing partition system.

26 Claims, 16 Drawing Sheets

U.S. PATENT DOCUMENTS 3,024,075 A 3/1962 Howe
3,179,480 A 4/1965 Brinker
3,273,952 A * 9/1966 Himelreich et al. ..... 312/348.1
3,346,311 A 10/1967 Bears
3,358,692 A 12/1967 Proulx
3,547,300 A 12/1970 Studinksi et al.
3,565,502 A 2/1971 Bracy et al.
3,649,095 A * 3/1972 Gunzburg ..... 312/333
3,650,586 A 3/1972 Nightingale et al.
3,705,754 A * 12/1972 Drum et al. ..... 312/409
3,752,553 A 8/1973 Bildahl et al.
3,799,638 A 3/1974 Faiks
3,809,449 A 5/1974 Beaver
3,838,902 A 10/1974 Tenani
3,857,622 A 12/1974 Mohr et al.
3,862,789 A 1/1975 Korell et al.
3,883,196 A 5/1975 Mohr et al.
3,890,023 A 6/1975 Mohr et al.
3,900,236 A 8/1975 Goulish et al.
3,909,090 A 9/1975 Breckner et al.
3,920,298 A 11/1975 Lopez
3,933,402 A 1/1976 Peterson
4,013,254 A 3/1977 Boundy et al.
4,102,470 A 7/1978 Timmons
4,176,889 A 12/1979 Gartung
4,239,309 A 12/1980 De Fouw et al.
4,298,236 A 11/1981 Laroche
4,355,851 A 10/1982 Slusser
4,429,930 A 2/1984 Blouin
4,441,767 A 4/1984 Stark
4,480,883 A 11/1984 Young
4,541,599 A 9/1985 Schoumaker
4,633,789 A 1/1987 Kortering et al.
4,637,667 A 1/1987 Reid et al.
4,660,905 A 4/1987 Conner et al.
4,671,481 A 6/1987 Beard
4,732,430 A 3/1988 Byrns
4,761,045 A 8/1988 Paine
4,768,844 A 9/1988 Ludwig
4,770,476 A 9/1988 Lakso
4,786,119 A 11/1988 Smuda
4,815,796 A 3/1989 Rock et al.
4,830,440 A 5/1989 Burch
4,865,404 A 9/1989 Harper
4,889,396 A 12/1989 Mitchell et al.
4,936,640 A 6/1990 Pratzer
4,957,334 A 9/1990 Lakso
4,966,423 A 10/1990 Higuera et al.
4,971,281 A 11/1990 Steinbeck
4,993,784 A 2/1991 Dana et al.
5,016,946 A * 5/1991 Reznikov et al. ..... 312/108
5,040,856 A * 8/1991 Wilkins et al. ..... 312/402
5,040,858 A 8/1991 Kruse et al.
5,050,942 A 9/1991 Frederick et al.
5,054,255 A 10/1991 Maninfior
5,056,876 A 10/1991 Scheerhorn
5,056,877 A 10/1991 Westwinkel
5,074,627 A 12/1991 Broeders
5,161,870 A 11/1992 Mason et al.
5,176,436 A 1/1993 Mitchell
5,184,887 A 2/1993 O'Keefe et al.
5,199,774 A 4/1993 Hedinger et al.
5,230,492 A 7/1993 Zwart et al.
5,303,994 A 4/1994 Elsholz
5,309,686 A 5/1994 Underwood et al.
5,312,180 A 5/1994 Tieder et al.
5,333,949 A 8/1994 McGregor
5,335,986 A 8/1994 Hartrum et al.
5,352,030 A 10/1994 Derle et al.
5,427,445 A 6/1995 Mitchell
5,433,516 A 7/1995 Beals et al.
5,437,503 A 8/1995 Baker et al.
5,494,246 A 2/1996 McCarthy et al.
5,567,027 A 10/1996 McClung et al.
5,599,077 A 2/1997 Law et al.
5,599,078 A 2/1997 Dechene et al.
5,702,167 A 12/1997 Muller
5,772,294 A 6/1998 Hendrich et al.
5,823,650 A 10/1998 Lin
5,855,423 A 1/1999 Cram
5,921,648 A 7/1999 Rong
5,931,548 A 8/1999 Bischoff
5,951,133 A 9/1999 Dittberner et al.
5,988,778 A 11/1999 Lammens
5,997,114 A 12/1999 Bischoff
6,007,170 A 12/1999 Liebertz et al.
6,050,661 A 4/2000 Fleisch
6,056,380 A 5/2000 Nien
6,082,839 A 7/2000 Chiku
6,109,708 A 8/2000 Walla et al.
6,112,485 A 9/2000 Beyer et al.
6,186,606 B1 2/2001 Krei
6,202,965 B1 3/2001 Chong
6,231,141 B1 5/2001 Liebertz et al.
6,312,186 B1 11/2001 Rock et al.
6,409,293 B1 6/2002 Chang
6,419,333 B2 7/2002 Liebertz et al.
6,428,129 B1 8/2002 Chen
6,450,596 B1 9/2002 Lee
6,516,507 B2 2/2003 Noel et al.
2002/0014817 A1 2/2002 Lammens
2002/0185943 A1 12/2002 Gentili et al.
2003/0062810 A1 4/2003 Westwinkel

FOREIGN PATENT DOCUMENTS

GB 2 071 995 9/1981
GB 2 199 737 7/1988

* cited by examiner

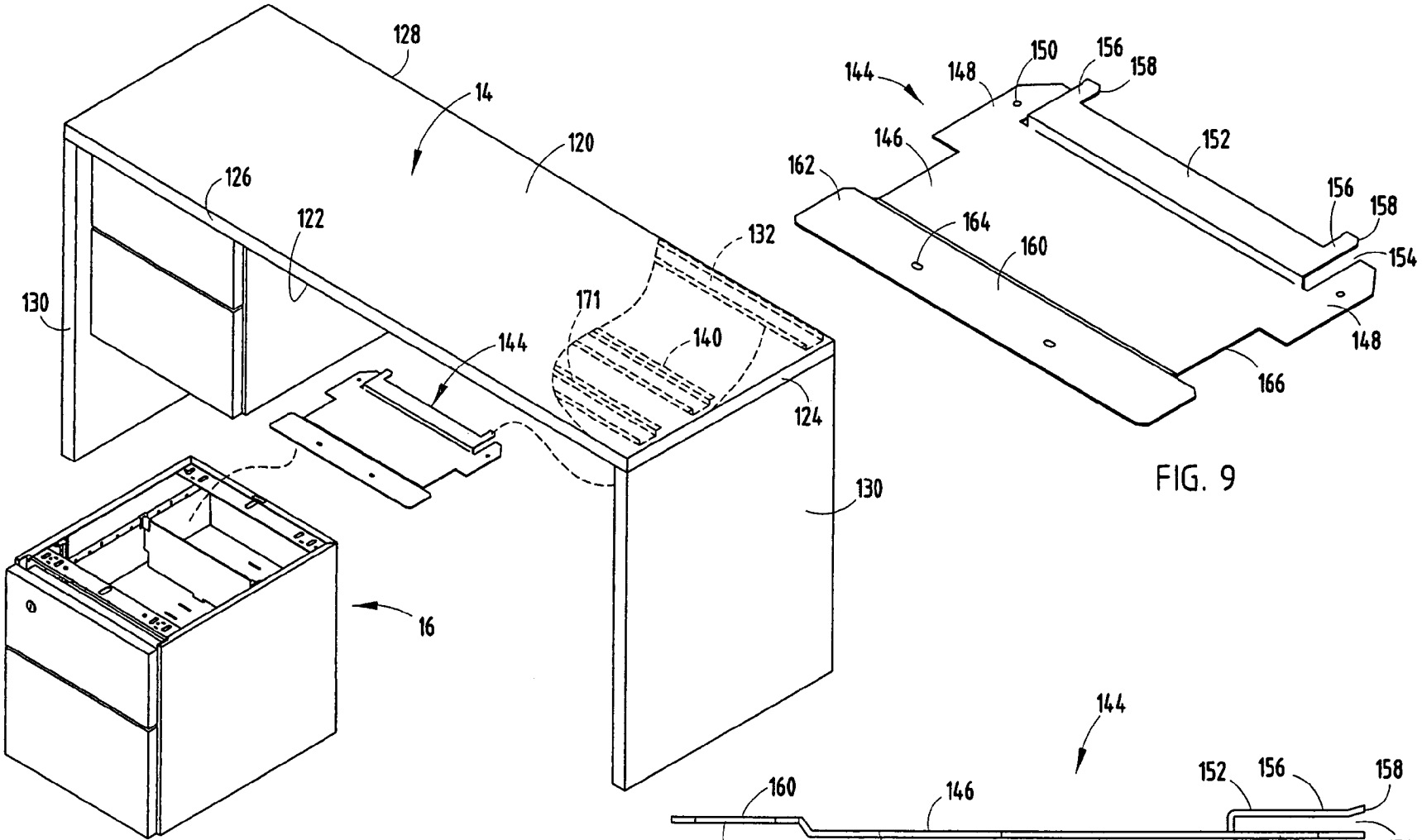
FIG. 9
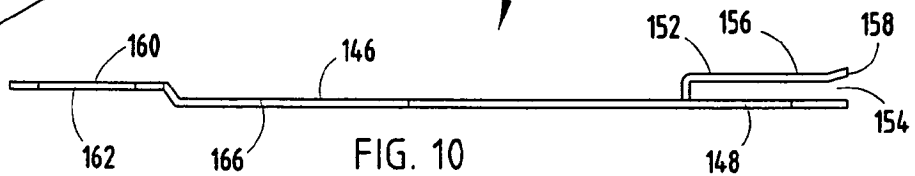
FIG. 10
FIG. 8

PEDESTAL SYSTEM

BACKGROUND OF THE INVENTION

The present invention relates to a pedestal system, and in particular to a plurality of connector assemblies and accessories for a pedestal system.

Storage devices such as filing cabinets for use within office settings are well known in the art. These storage devices typically include a cabinet defining an interior space and a plurality of drawers slidably mounted within the cabinet for conveniently storing office supplies and materials therein. Heretofore, these storage cabinets have typically required components and accessories that are uniquely designed for each particular storage cabinet, including uniquely designed coupling systems for coupling the storage cabinet to other office furniture, outer aesthetic cover plates for covering the exposed drawer ends associated therewith, as well as attachments for drawer lock/interlock assemblies. Moreover, these systems and assemblies of the known storage cabinets are typically complicated in design, thereby requiring specialized tools or skilled persons for assembly, and are typically expensive to manufacture.

A storage system is needed that utilizes coupling systems, drawer cover assemblies, drawer lock/interlock assemblies, and the like, that are interchangeable within various storage cabinet configurations, may be assembled/disassembled without the use of specially designed tools and/or personnel, and are relatively inexpensive to manufacture.

SUMMARY OF THE INVENTION

One aspect of the present invention is to provide a drawer assembly that includes a bottom wall, a pair of sidewalls opposed across the bottom wall from one another and extending upwardly from the bottom wall, a rear wall extending upwardly from the bottom wall and between the pair of sidewalls, and a front wall extending upwardly from the bottom wall between the pair of sidewalls and opposed across the bottom wall from the rear wall, wherein the front wall includes at least one laterally-extending flange located proximate an uppermost edge thereof. The drawer assembly also includes a face plate having at least one laterally-extending flange located substantially proximate an upper edge thereof, wherein at least a select one of a group consisting of at least one flange of the front wall and of the at least one flange of the face plate includes a pair of flanges defining a first gap therebetween, and wherein the remaining one of the group consisting of the at least one flange of the front wall and the at least one flange of the face plate includes an outwardly-extending first tab that is received into the gap, thereby coupling the face plate with the front wall.

Another aspect of the present invention is to provide a drawer assembly that includes a bottom wall, a pair of sidewalls opposed across the bottom wall from one another and extending upwardly from the bottom wall, a rear wall extending upwardly from the bottom wall and between the pair of sidewalls, and a front wall extending upwardly from the bottom wall between the pair of sidewalls and opposed across the bottom wall from the rear wall, wherein the front wall includes at least one laterally-extending flange located proximate an uppermost edge thereof, and at least one forwardly-extending tab located along a side edge of the front wall. The drawer assembly also includes a face plate having at least one laterally-extending flange located substantially proximate an uppermost edge thereof, and a rearwardly-exposed abutment surface, wherein the flange of the front and the flange of the face plate engage one another, and wherein the tab of front wall engages the abutment surface of the face plate, thereby coupling the face plate with the front wall.

Yet another aspect of the present invention is to provide a storage cabinet that includes a housing member including a pair of sidewalls, a rear wall, a top wall and a bottom wall cooperating to define an interior space and a forwardly-facing aperture providing access to the interior space, and at least one drawer assembly operably coupled to the housing member for rectilinear movement into and from the interior of the housing member. The at least one drawer assembly includes a bottom wall, a pair of sidewalls opposed across the bottom wall of the at least one drawer assembly from one another and extending upwardly from the bottom wall of the at least one drawer assembly, a rear wall extending upwardly from the bottom wall of the at least one drawer assembly and between the pair of sidewalls of the at least one drawer assembly, and a front wall extending upwardly from the bottom wall of the at least one drawer assembly between the pair of sidewalls of the at least one drawer assembly and opposed across the bottom wall of the at least one drawer assembly from the rear wall of the at least one drawer assembly, wherein the front wall includes at least one laterally-extending flange located proximate an uppermost edge thereof. The at least one drawer assembly further includes a face plate having at least one laterally-extending flange located substantially proximate an upper edge thereof. At least a select one of a group consisting of the at least one flange of the front wall of the least one drawer assembly and of the least one flange of the face plate includes a pair of flanges defining a first gap therebetween, and wherein the remaining one of the group consisting of the at least one flange of the front wall of the at least one drawer assembly and the at least one flange of the faceplate includes an outwardly-extending first tab that is received into the gap, thereby coupling the face plate with the front wall of the at least one door assembly.

Still yet another aspect of the present invention is to provide a storage cabinet that includes a housing member including a pair of sidewalls, a rear wall, a top wall and a bottom wall that cooperate to define an interior space and a forwardly-facing aperture providing access to the interior space, and at least one drawer assembly operably coupled to the housing member for rectilinear movement into and from the interior of the housing member. The at least one drawer assembly includes a bottom wall, a pair of sidewalls opposed across the bottom wall of the at least one drawer assembly from one another and extending upwardly from the bottom wall of the at least one drawer assembly and between the pair of sidewalls of the at least one drawer assembly, and a front wall extending upwardly from the bottom wall of the least one drawer assembly and between the pair of sidewalls of the least one drawer assembly, and opposed across the bottom wall of the at least one drawer assembly from the rear wall of the at least one drawer assembly, wherein the front wall includes at least one laterally-extending flange located proximate an uppermost edge thereof, and at least one forwardly-extending tab located along a side edge of the front wall. The at least one drawer assembly further includes a face plate having at least one laterally-extending flange located substantially proximate an upper edge thereof, and a rearwardly-exposed abutment surface. The flange of the front wall of the at least one drawer assembly and the flange of the faceplate engage one another, and the tab of the front wall of the at least one drawer assembly engages the abutment surface of the faceplate, thereby coupling the face plate with the front wall of the at least one drawer assembly.

Another aspect of the present invention is to provide a coupling system for coupling a furniture component to a free-standing partition assembly, wherein the partition assembly includes a connector member having a plurality of longitudinally-extending and aligned slots located in an outwardly exposed face thereof. The coupling assembly includes a first bracket adapted to couple to a furniture component and having a plurality of first engagement members spaced along a length thereof and adapted to engage a plurality of first slots of a connector member of a partition assembly, and a second bracket adapted to couple to a furniture component and having a plurality of second engagement members located along a length thereof and adapted to engage a plurality of second slots of a connector member longitudinally aligned with a plurality of first slots, and wherein the second bracket is longitudinally shiftable with respect to the first bracket prior to coupling the second bracket with a furniture component.

Still another aspect of the present invention is to provide a furniture system that includes a free-standing partition assembly that includes a connector member having a plurality of longitudinally-extending and aligned slots located in an outwardly exposed face thereof, a furniture component, and a coupling assembly. The coupling assembly includes a first bracket coupled to the furniture component and having a plurality of first engagement members spaced along the length thereof, wherein the first engagement members are engaged within a portion of a plurality of slots of the connector member, and a second bracket coupled to the furniture component and having a plurality of second engagement members spaced along the length thereof and engaged within a portion of the plurality of slots of the connector member, wherein the second bracket is longitudinally shiftable with respect to the first bracket prior to the second bracket being coupled with the furniture component.

Yet another aspect of the present invention is to provide a connection plate for supporting a furniture component from a worksurface that includes a body portion adapted to couple to a furniture component, and at least one engagement member extending forwardly of the body portion and adapted to slidably engage a first bracket extending below and coupled to a worksurface. The connector plate further includes a forward portion extending forward of the body portion and adapted to couple with a second bracket extending below and coupled to the worksurface.

Still yet another aspect of the present invention is to provide a furniture assembly that includes a worksurface, a first bracket affixed to an underside of the worksurface, and a second bracket affixed to an underside of the worksurface. The furniture assembly also includes a furniture component including a bottom wall, a pair of sidewalls extending upwardly from and opposed across the bottom wall from one another, a rear wall extending upwardly from the bottom wall and between the sidewalls, and a rim extending inwardly from and along upper edges of the sidewalls and the rear wall. The furniture system further includes a connection plate that includes a body portion coupled with the flange of the furniture component, at least one engagement member extending forward of the body portion and slidably engaging the first bracket, and a forward portion extending forward of the body portion and coupled with the second bracket, thereby supporting the furniture component from the worksurface.

Another aspect of the present invention is to provide a divider for segmenting an interior space of a drawer assembly, the drawer assembly including a bottom wall having a plurality of apertures spaced along a length thereof, a pair of sidewalls extending upwardly from and opposed across the bottom wall from one another, wherein each sidewall includes a plurality of notches spaced along the length thereof, and aligned with the apertures of the bottom wall. The divider including a substantially planar body portion having a top edge, a bottom edge and pair of side edges, a first tab member extending downwardly from the bottom edge of the body portion, wherein the first tab member is adapted to engage an aperture in a bottom wall of the drawer assembly, and a pair of second tab members extending outwardly from the side edges of the body portion, wherein the second tab members are adapted to engage notches in a pair of sidewalls of a drawer assembly, thereby positively locating the divider within a drawer assembly.

Yet another aspect of the present invention is to provide a drawer assembly that includes a bottom wall having a plurality of apertures spaced along a length thereof, a pair of sidewalls extending upwardly from and opposed across the bottom wall from one another, wherein each sidewall has a plurality of apertures spaced along the length thereof, a back wall extending upwardly from the bottom wall and between the sidewalls, and a front wall extending upwardly from the bottom wall and between the sidewalls. The drawer assembly further includes a drawer divider including a substantially planar body portion having a top edge, a bottom edge and a pair of side edges, a first tab member extending downwardly from the bottom edge of the body portion, wherein the first tab member engages one of the apertures in the bottom wall, and a pair of second apertures extending outwardly from the side edges of the body portion, wherein the second tab members engage notches in the sidewalls, thereby positively locating the divider along the length of the bottom and sidewalls.

Still another aspect of the present invention is to provide an attachment assembly for coupling a lock/interlock drawer assembly within an interior of a furniture component, wherein the furniture component includes a bottom wall, a top wall, a pair of sidewalls, and a rear wall that cooperate to define the interior space and a forwardly-facing opening adapted to receive at least one drawer assembly therein, such that the at least one drawer assembly is moveable between an open position, wherein the drawer assembly extends at least partially outwardly from the interior of the furniture component, and a closed position, wherein the drawer assembly is retracted into the interior of the furniture component. The attachment assembly comprises a guide member having a longitudinally-extending channel, a first end and a second end, and at least one drawer locking assembly slidably received within the channel of the guide member and adapted to engage the at least one drawer assembly disposed within a furniture component. Each drawer lock assembly is operable between a locked position, wherein at least one drawer assembly is prevented from being moved from a closed position, to an unlocked position, wherein at least one drawer assembly may be moved from a closed position to an open position. The attachment assembly further includes a top connector having a downwardly-exposed recess receiving the first end of the guide member therein, and at least one tab member adapted to engage an aperture within the furniture component, thereby coupling the first end of the guide member to a furniture component, and a bottom connector member having an upwardly-exposed recess receiving the second end of the guide member therein, and at least one tab member adapted to engage an aperture within the furniture component, thereby coupling the second end of the guide member to a furniture component.

Still another aspect of the present invention is to provide a furniture system that includes a furniture component including a bottom wall, a top wall, a pair of sidewalls and a rear wall that cooperate to define an interior space and a forwardly-facing opening, and at least one drawer assembly mounted within the interior space of the furniture component such that the drawer assembly is moveable between an open position, wherein the drawer assembly extends at least partially outwardly from the interior of the furniture component, and a closed position, wherein the drawer assembly is retracted into the interior of the furniture component. The furniture system also includes a guide member having a longitudinally-extending channel, a first end and a second end, and at least one drawer locking assembly slidably received within the channel of the guide member and adapted to engage the at least one drawer assembly disposed within the furniture component. Each drawer lock assembly is operable between a locked position, wherein the at least one drawer assembly is prevented from being moved from the closed position to the open position, and an unlocked position, wherein the at least one drawer assembly is moveable from the closed position to the open position. The furniture system further includes a top connector member having a downwardly-exposed recess receiving the first end of the guide member therein, and at least one tab member engaging an aperture within one of the sidewalls, thereby coupling the first end of the guide member to the furniture component, and a bottom connector having an upwardly-exposed recess receiving the second end of the guide member therein, and at least one tab member engaging an aperture within the furniture component, thereby coupling a second end of the guide member to the furniture component.

Still yet another aspect of the present invention is to provide a furniture system that includes a furniture component including a bottom wall, a top wall, a pair of sidewalls and a rear wall that cooperate to define an interior space and a forwardly-facing opening, and at least one drawer assembly mounted within the interior space of the furniture component such that the drawer assembly is moveable between an open position wherein the drawer assembly extends at least partially outwardly from the interior of the furniture component, and a closed position, wherein the drawer assembly is retracted into the interior of the furniture component. The furniture system also includes a guide member having a longitudinally-extending channel, a first end and a second end, and at least one drawer locking assembly slidably received within the channel of the guide member and adapted to engage the at least one drawer assembly disposed within the furniture component. Each drawer lock assembly is operable between a locked position, wherein the at least one drawer assembly is prevented from being moved from the closed position to the open position, to an unlocked position, wherein the at least one drawer assembly is moveable from the closed position to the open position. The furniture system further includes a top connector member having a downwardly-exposed recess receiving the first end of the guide member therein, and at least one tab member engaging an aperture within one of the sidewalls, thereby coupling the first end of the guide member to the furniture component, and a bottom connector member having an upwardly-exposed recess receiving the second end of the guide member therein, and at least one tab member engaging an aperture within the furniture component, thereby coupling the second end of the guide member to the furniture component.

Yet another aspect of the present invention is to provide a drawer lock/interlock assembly for a furniture component including an interior space and a forwardly-facing opening adapted to slidably receive at least two drawer assemblies therein, each drawer assembly being slidable between an open position, wherein the drawer assembly extends at least partially outwardly from the interior of the furniture component, and a closed position, wherein the drawer assembly is retracted into the interior of the furniture component, and further wherein each drawer assembly includes a pin member fixedly attached thereto. The drawer lock/interlock assembly includes a guide member having a longitudinally-extending channel, and a cam member slidably coupled to the guide member and having an arcuately-shaped cam surface adapted to abut a pin member of the drawer assembly when the drawer assembly is moved from a closed position to an open position, wherein the cam surface is shaped such that a force exerted on a drawer assembly to move a drawer assembly from a closed position to an open position remains constant.

The present inventive pedestal system includes assemblies and subsystems that may be utilized within a wide variety of storage systems, are relatively inexpensive to manufacture, and may be assembled/disassembled without the use of specialized tools and/or skilled personnel. Moreover, the pedestal system disclosed herein is efficient in assembly/disassembly as well as in use, is capable of a long-operating life, and is particularly well adapted for the proposed use.

These and other advantages of the invention will be further understood and appreciated by those skilled in the art by reference to the following written specification, claims and appended drawings.

BRIEF DESCRIPTION OF THE DRAWINGS

FIG. 8 is an exploded perspective view of a pedestal system and a hanger bracket for supporting the pedestal system from a worksurface with a portion of the worksurface shown in dashed line to reveal lower beams associated therewith;

FIG. 9 is a perspective view of the hanger bracket;

FIG. 10 is a side view of the hanger bracket;

DETAILED DESCRIPTION OF THE PREFERRED EMBODIMENTS

Figure 1:
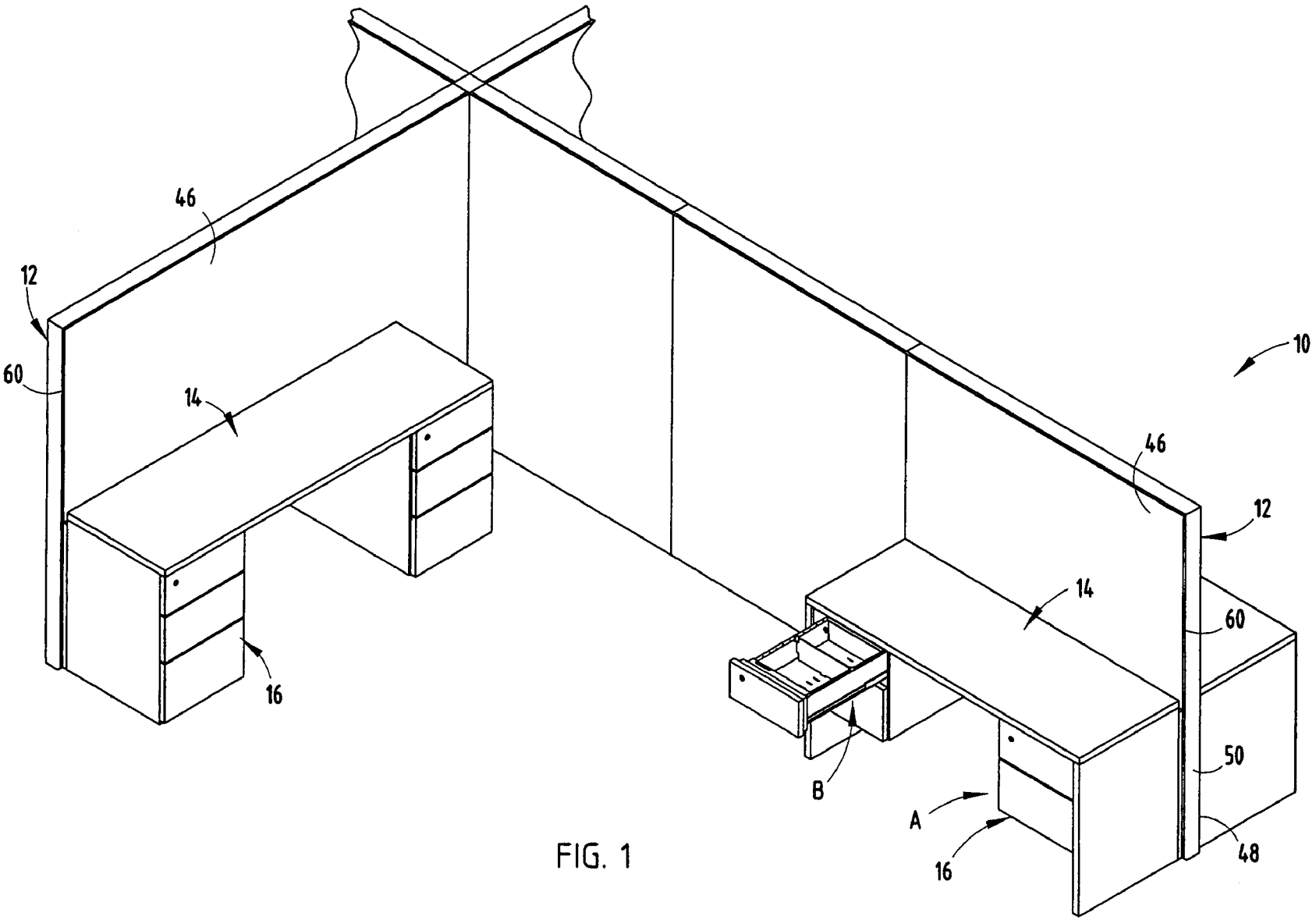
FIG. 1 is a top perspective view of a furniture system embodying the present invention and including partition panels, pedestal systems and worksurfaces.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 generally designates a furniture system (FIG. 1) that includes a plurality of partition panels 12 and a plurality of worksurfaces 14 supported by a plurality of pedestal systems 16. As illustrated, the pedestal systems 16 are configured so as to be coupled with the partition panels 12 and/or the associated worksurfaces 14.

Figure 2:
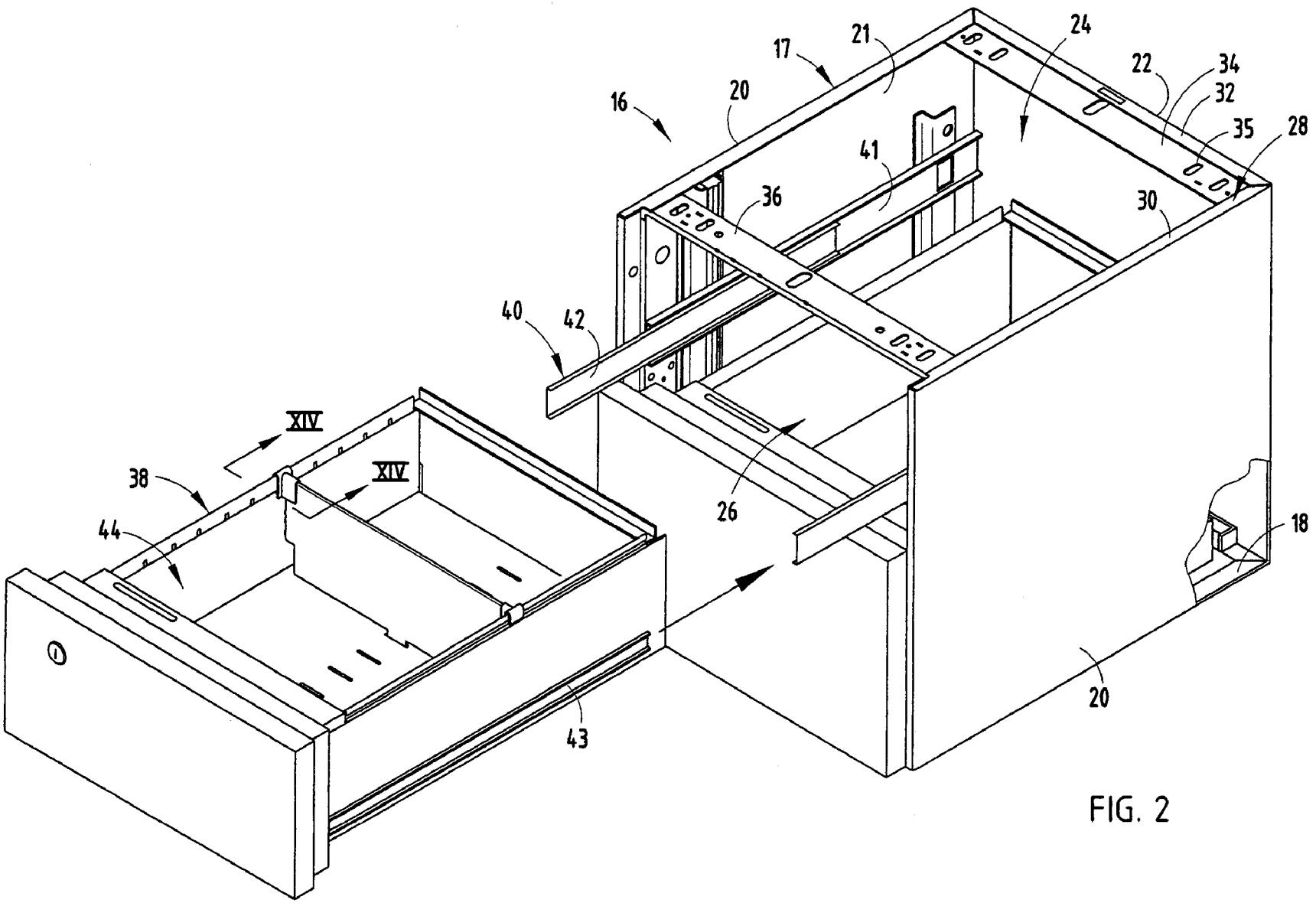
FIG. 2 is a perspective view of a pedestal system, wherein a drawer assembly of the pedestal system is exploded from within a housing, and wherein a drawer divider subdivides the drawer assembly.

Each pedestal system 16 (FIG. 2) includes a housing 17 having a bottom wall 18, a pair of sidewalls 20 extending upwardly from and opposed across the bottom wall 18 from one another, and a rear wall 22 extending upwardly from the bottom wall 18 and between the sidewalls 20. The bottom wall 18, sidewalls 20 and rear wall 22 cooperate with one another to define an interior space 24 and a forwardly-facing front opening 26 providing access to the interior space 24. A lip 28 extends about an uppermost periphery of the sidewalls 20 and rear wall 22 and includes a pair of flanges 30 extending inwardly from each sidewall 20, a flange 32 extending forwardly from the rear wall 22, a rear structural member 34 extending between the sidewalls 20 proximate the flange 32 of the rear wall 22, and a front structural member 36 extending between the sidewalls 20 and located forwardly of the rear structural member 34. Each pedestal system 16 further includes a plurality of drawer assemblies 38 slidable supported within the housing 17 by drawer supports 40 located on opposite sides of each drawer assembly 38. The drawer supports 40 allow each drawer assembly 38 to be moved from between a storage position A (FIG. 1), wherein the drawer assembly 38 is retracted into the interior space 24 of the housing 17, and an open position B, wherein the drawer assembly 38 is at least partially extended from within the interior space 24 of the housing 17, thereby allowing access to an interior space thereof. Specifically, each drawer assembly 38 is slidably supported by a pair of drawer supports 40 each including a track member 41 affixed to an interior surface 21 of the associated sidewall 20, at least one first slide member 42 slidably coupled with the track member 41, and a second slide member 43 affixed to the associated drawer assembly 38 and slidably coupled with the first slide member 42, in a manner as known in the art. The second slide member 43 is coupled with the first slide member 42 in a manner that allows separation therebetween, thereby allowing the associated drawer assembly 38 to be completely removed from within the interior space 24 of the housing 17, as is further known in the art.

Figure 4:
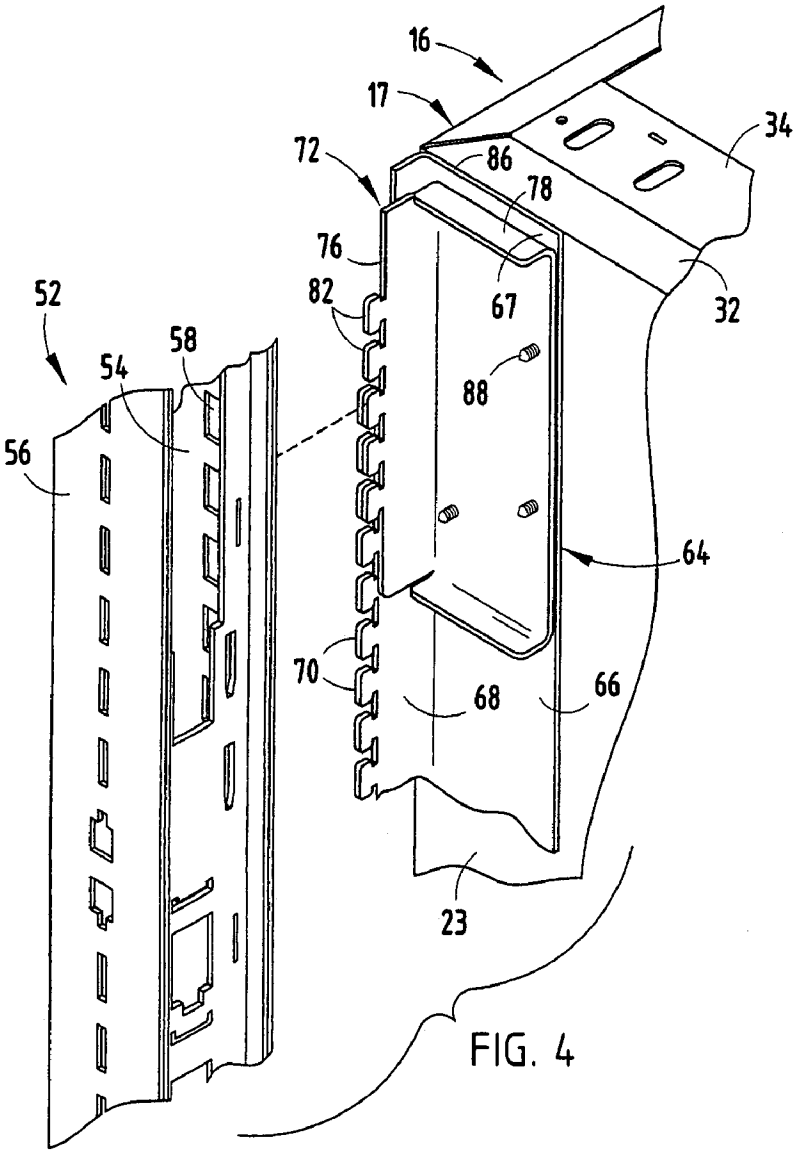
FIG. 4 is a rear perspective view of the first embodiment of the connector assembly shown connecting a pedestal system to a partition panel.
Figure 7:
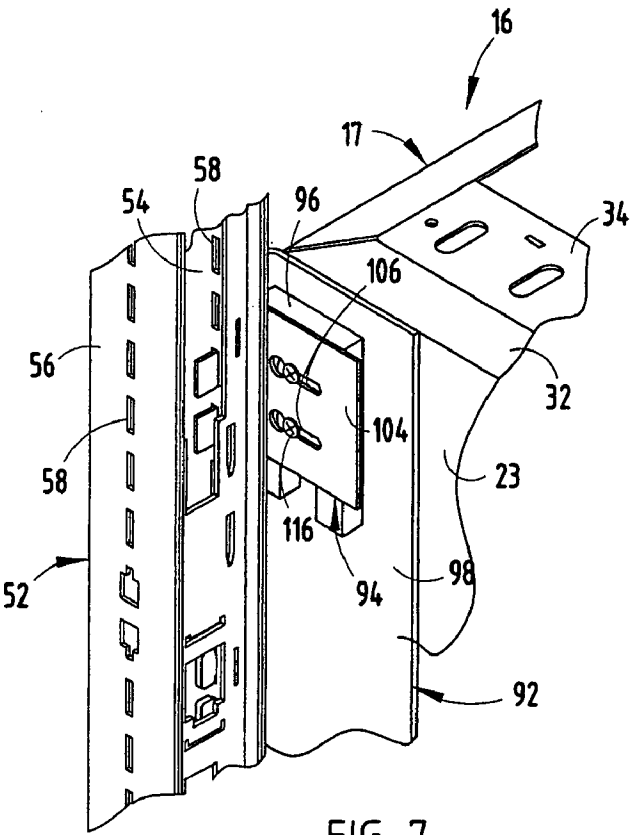
FIG. 7 is a rear perspective view of the second embodiment of the connector assembly shown connecting a pedestal system to a partition panel.
Figure 6:
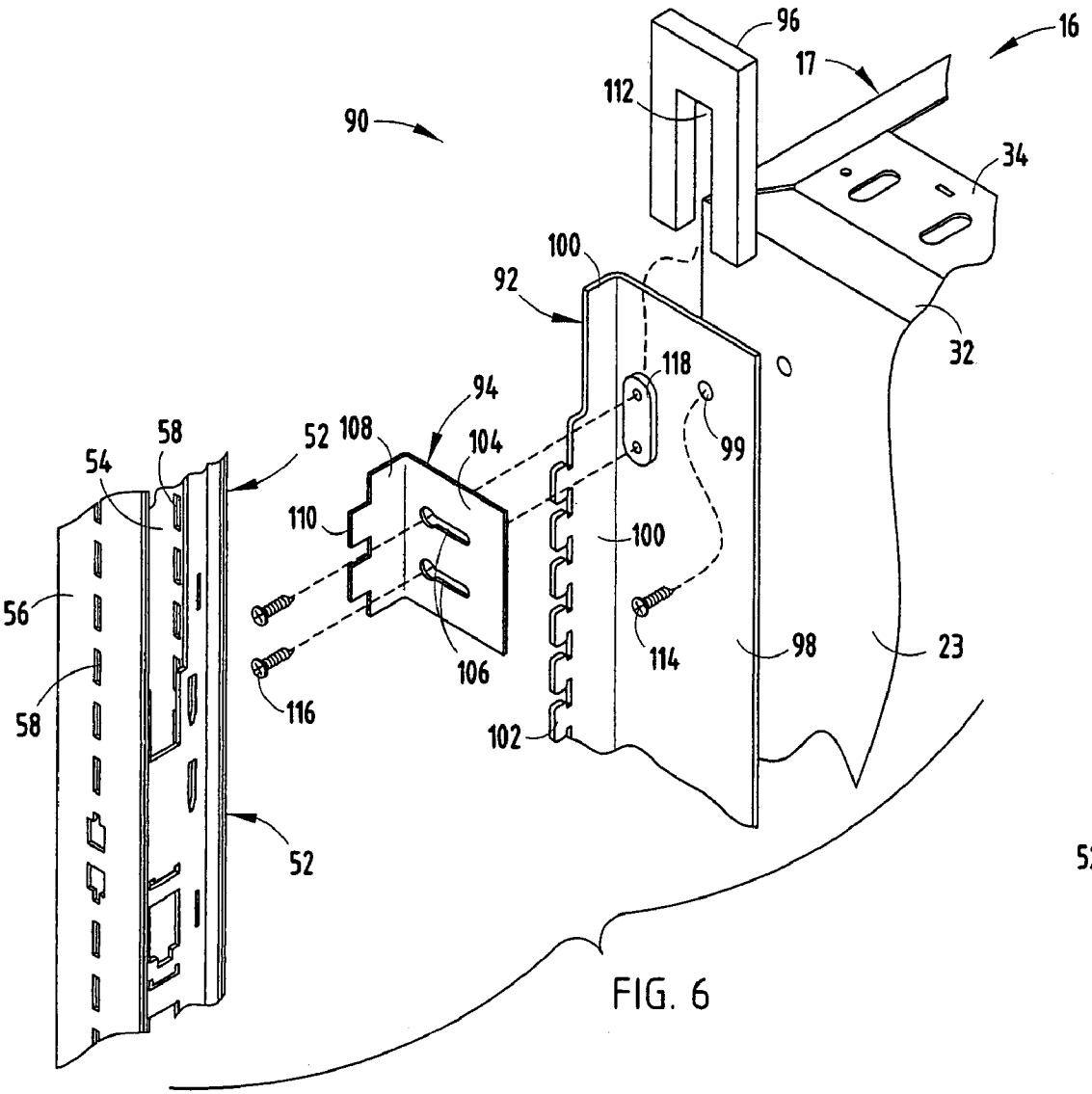
FIG. 6 is an exploded rear perspective view of a second embodiment of a connector assembly.

The partition assembly 12 includes a plurality of partition panels 46 supported between a plurality of support posts 48. Each support post 48 includes a cover member 50 covering a post member 52 (FIG. 4) therein. Each post member 52 includes a forward surface 54 and a rearward surface 56 each including a plurality of longitudinally-extending and aligned slots 58. Each cover member 50 includes longitudinally-extending channels 60 that align with and provide access to the slots 58 when the cover member 50 is assembled about the associated post member 52.

Figure 3B:
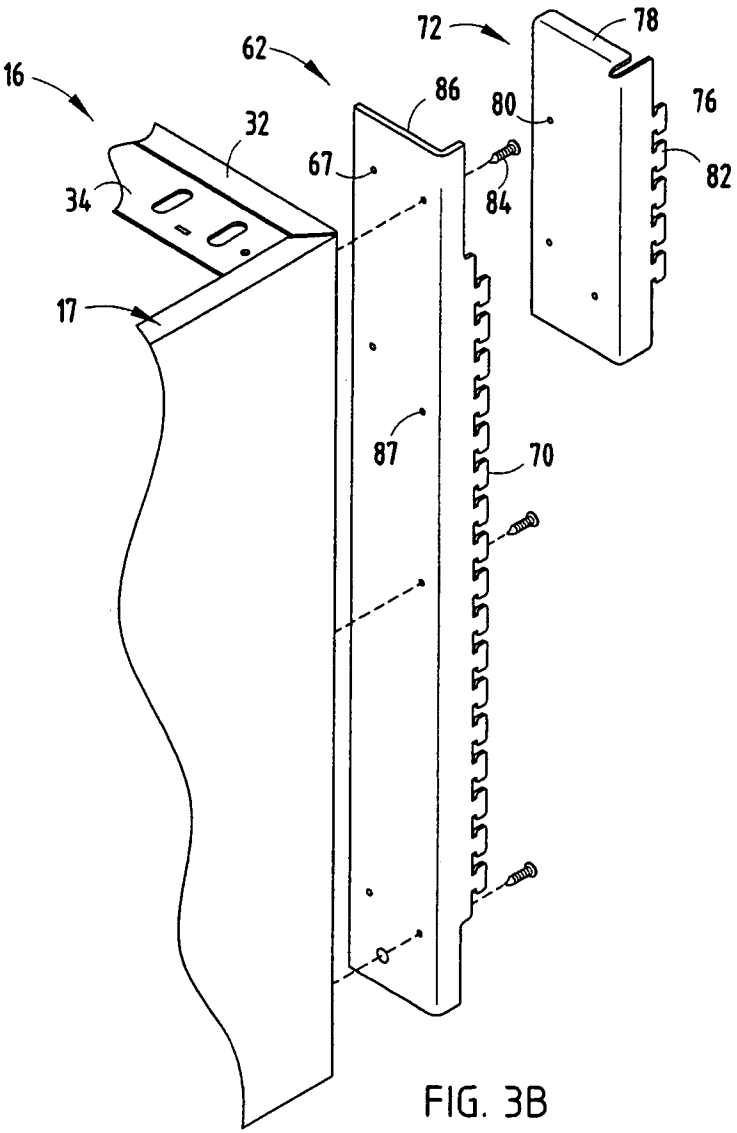
FIG. 3B is an exploded front perspective view of the first embodiment of the connector assembly.
Figure 3A:
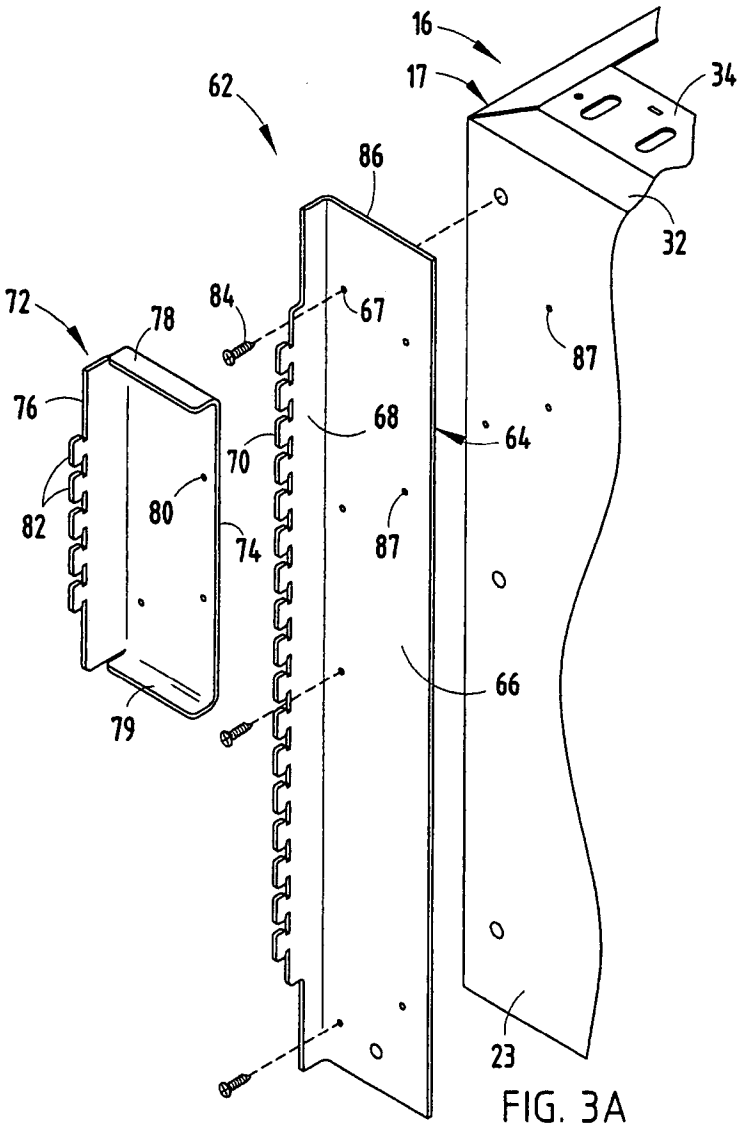
FIG. 3A is an exploded rear perspective view of a first embodiment of a connector assembly.

In a first embodiment, the housing 17 (FIGS. 3A and 3B) of each pedestal system 16 is coupled with a post member 52 of the partition assembly 12 by a coupling assembly 62. The coupling assembly 62 includes an L-shaped first mounting bracket 64 having an elongated, planar body portion 66 and a coupling flange 68 extending orthogonally and rearwardly from the body portion 66. The body portion 66 includes a plurality of apertures 67 extending therethrough. The coupling flange 68 includes a plurality of rearwardly-extending T-shaped tabs 70 extending along the length of the first mounting bracket 64. The coupling assembly 62 further includes a second mounting bracket 72 having a planar body portion 74, a coupling flange 76 extending rearwardly from and orthogonally to the body portion 74, a top flange 78 located near an end of the body portion 74 and extending laterally across and orthogonally thereto, and a bottom flange 79 located near an end of the body portion 74 opposite the flange 78, and extending across and orthogonal to the body portion 74. The body portion 74 includes a plurality of apertures 80 extending therethrough. The coupling flange 76 includes a plurality of rearwardly-extending, T-shaped tabs 82 extending along the length thereof.

Figure 5B:
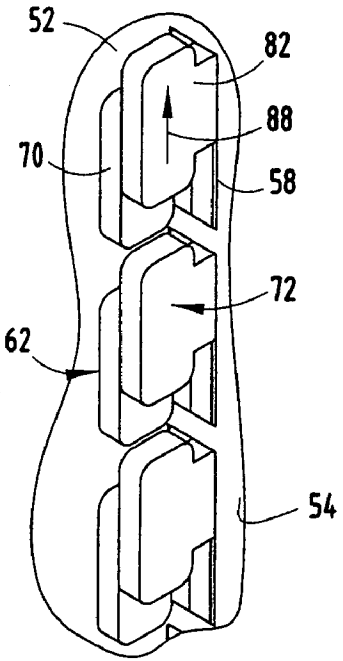
FIG. 5B is a perspective rear view of the plurality of tabs of the first and second brackets of the first embodiment of the connector assembly shown in a locked position.
Figure 5A:
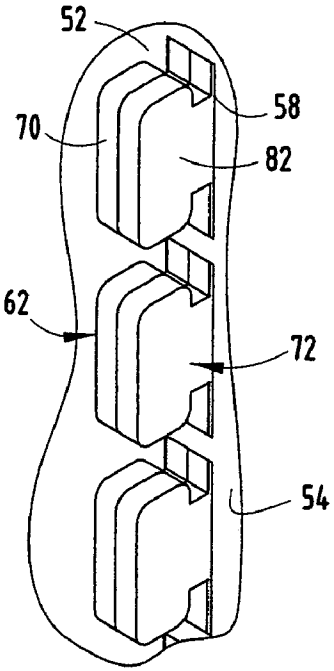
FIG. 5A is a perspective view of a plurality of tabs of a first bracket and a second bracket of the first embodiment of the connector assembly shown in an unlocked position.

In assembly, the first mounting bracket 64 is secured to a rear surface 23 of the rear wall 22 by a plurality of mechanical fasteners such as machine screws 84 that are received within the apertures 67 of the first mounting bracket 64 and are self-tapped into the rear wall 22 of the housing 17, such that the body portion 66 of the first mounting bracket 64 abuts the rear surface 23 of the rear wall 22 and is securely fastened thereto. The second mounting bracket 72 is then aligned with the first mounting bracket 64 such that the body portion 74 of the second mounting bracket 72 abuts the body portion 66 of the first mounting bracket 64 and the flange 78 of the second mounting bracket 72 is closely aligned with an end 86 of the first mounting bracket 64. The second mounting bracket 72 is then used as a template for marking the location of the apertures 80 of the second mounting bracket 72 onto the body portion 66 of the first mounting bracket 64. The second mounting bracket 72 is then removed and holes 87 are drilled through the body portion 66 of the first mounting bracket 64 and the rear wall 22 of the housing 17 at the locations as marked and corresponding to the apertures 80 of the second mounting bracket 72. The second mounting bracket 72 (FIG. 5A) is then assembled with the post member 52 by inserting the tabs 82 of the second mounting bracket 72 into the slots 58 of the post member 52. The first mounting bracket 64, along with the associated housing 17, is then positioned such that the tabs 70 of the first mounting bracket 64 engage the slots 58 of the post member 52, and the rear wall 22 of the housing 17 is located proximate the associated partition panel 46. The flange 78 of the second mounting bracket 72 is then grasped, either by hand or by use of a tool, and moved upwardly in a direction as indicated and represented by directional arrow 88 (FIG. 5B), such that the tabs 82 of the second mounting bracket 72 and the tab 70 of the first mounting bracket 64 engage the slots 58 of the post member 52, thereby securely coupling the pedestal system 16 to the partition assembly 12. A plurality of mechanical fasteners such as screws 88 are then used to secure the second mounting bracket 72 in place by accessing the apertures 87 of the rear wall 82 and first mounting bracket 64 and the apertures 80 of the second mounting bracket 72 through the interior space 24 of the housing 17.

In a second embodiment, a coupling assembly 90 is utilized to couple the housing 17 of the associated pedestal system 16 to the partition assembly 12. The coupling assembly 90 includes a first mounting bracket 92, a second mounting bracket 94, and a wedge 96. The first mounting bracket 92 is L-shaped and includes a planar body portion 98 and a coupling flange 100 extending rearwardly from and orthogonally to the body portion 98. The body portion 98 includes a plurality of apertures 99 extending therethrough. The first mounting bracket 92 further includes a plurality of T-shaped tabs 102 spaced along the length of and extending rearwardly from the coupling flange 100. The second mounting bracket 94 is L-shaped and includes a body portion 104 having a pair of laterally-extending slots 106, and a coupling flange 108 extending rearwardly from and orthogonally to the body portion 104. The coupling flange 108 includes a pair of rearwardly-facing, rectangularly-shaped, spaced-apart tabs 110. The tabs 110 are each provided with a width that is only slightly less than the length of each slot 58 of the post member 52. The wedge member 96 is U-shaped and includes a centrally disposed slot 112.

In assembly, the first mounting bracket 22 is affixed to the rear wall 22 of the housing 17 by a plurality of mechanical fasteners such as screws 114 that are received within the apertures 99 of the first mounting bracket 92 and are self-tapped into the rear wall 22 of the housing 17, such that the body portion 98 of the first mounting bracket 92 abuts and is securely fastened to the rear surface 23 of the rear wall 22. A pair of screws 116 are extended through the slots 106 and secured into a weld nut 118 such that the second mounting bracket 94 is still allowed to float along a length of the screws 116. The second mounting bracket 94 is then assembled with the associated post member 52 by inserting the tabs 110 of the second mounting bracket 94 into the slots 58 of the post member 52, and is held in place until the first mounting bracket 92 and the housing 17 are moved into position. The first mounting bracket 92 and the housing 17 are moved into position such that the tabs 102 of the first mounting bracket 92 are received within the slots 58 of the post member 52 and the second mounting bracket 94 is trapped between the first mounting bracket 92 and the post member 52. In order to properly position the first mounting bracket 92 and the housing 17 with respect to the post member 52, the housing 17 and the first mounting bracket 92 must be elevated with respect to the post member, moved rearwardly until the tabs 102 of the first mounting bracket 92 are received within the slots 58 of the post member 52, and lowered with respect to the post member 52, such that the tabs 102 of the first mounting bracket 92 engage the slots 58 of the post member 52. It should be noted that the second mounting bracket 94 is allowed to float along a length of the screws 116 at this point during the assembly. The second mounting bracket 94 is then secured into position by inserting the wedge member 96 between the body portion 98 of the first mounting bracket 92 and the body portion 104 of the second mounting bracket 94, and such that the weld nut 118 is received into the slot 112 of the wedge member 96, thereby preventing the second mounting bracket 94 from sliding along a length of the screws 116 and forcing the tabs 110 of the second mounting bracket 94 to remain engaged into the slots 58 of the post member 52, thereby preventing dislodgement of the tabs 102 of the first mounting bracket 92 from within the slots 58 of the post member 52.

In a third embodiment, the pedestal system 16 (FIG. 8) may be hangingly supported from an associated worksurface 14. The worksurface 14 includes a top surface 120, a bottom surface 122, ends 124, a front edge 126, and a rear edge 128. The worksurface 14 (FIG. 1) may be supported at either end 124 by an end wall 130 extending between the floor and the associated end 124 to which the end wall 130 is secured, a pedestal system 16, or may be secured to the partition assembly 12 along the rear edge 128 of the worksurface 14 in a manner as is known in the art. In the illustrated example, a first support bracket 132 is affixed to the bottom surface 122 of the worksurface 14 and extends longitudinally therealong proximate the rear edge 128. The first support bracket 132 (FIG. 11D) includes a plurality of slots 134 extending along the length thereof. A second support bracket 140 extends longitudinally along and is affixed to the bottom surface 122 of the worksurface 14. The second support bracket 140 includes a plurality of apertures 142 spaced along the length thereof.

A connection plate 144 is positioned between the worksurface 14 and the pedestal system 16 and supports the pedestal system 16 from the worksurface 14. The connection plate 144 (FIGS. 9 and 10) includes a planar body portion 146 having a pair of support arms 148 extending laterally outwardly and rearwardly therefrom. Each support arm 148 includes an aperture 150 extending therethrough. The connection plate 144 also includes a planar engagement member 152 extending upwardly and rearwardly from the body portion 146, thereby forming a gap 154 between the engagement member 152 and the support arms 148 of the body portion 146. The engagement member 152 extends laterally across the body portion 146 and includes a pair of rearwardly-extending tab members 156 each including an upwardly-turned tip 158. The connection plate 144 further includes a planar forward portion 160 extending forwardly from the body portion 146 and that includes a pair of laterally outwardly extending tabs 162, and a plurality of apertures 164 extending therethrough. The forward portion 160 is upwardly offset from the body portion 146. The support arms 148 of the body portion 146 and the tabs 162 of the forward portion 160 are configured so as to provide an offset or relief 166 therebetween.

Figure 11C:
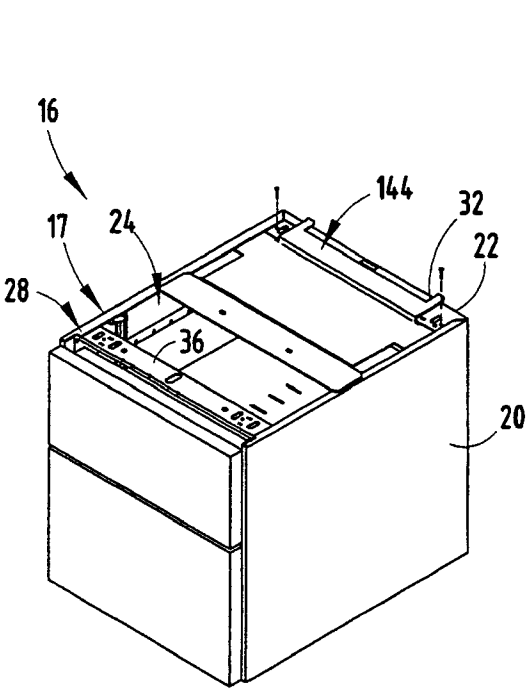
FIG. 11C is a perspective view of the pedestal system and the hanger bracket and a third step of assembly thereof.
Figure 11B:
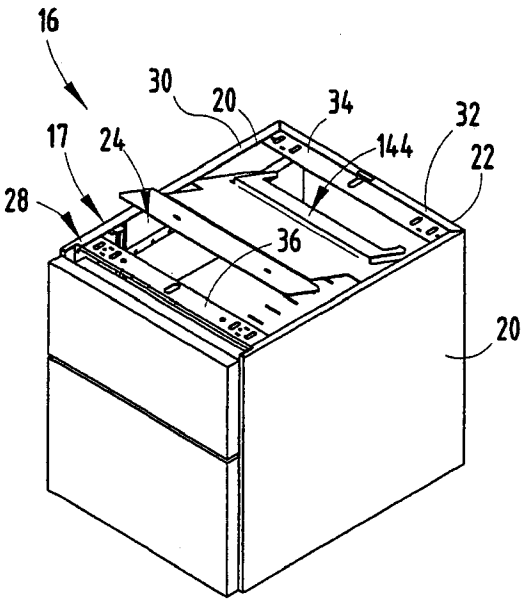
FIG. 11B is a perspective view of the pedestal system and the hanger bracket and a second step of assembly thereof.
Figure 11A:
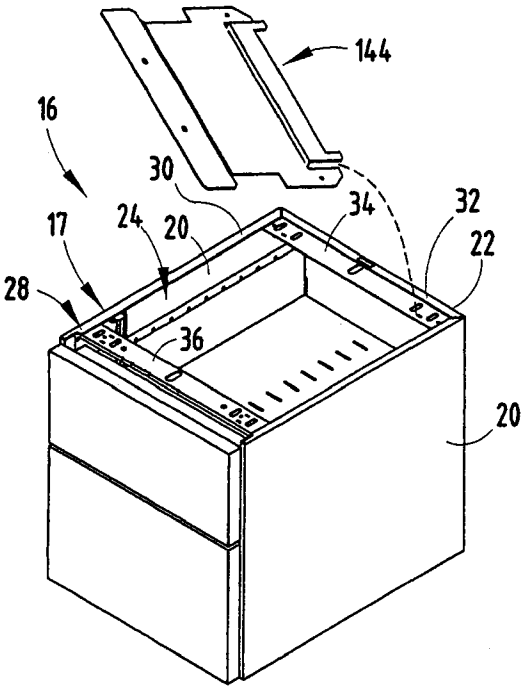
FIG. 11A is a perspective view of the pedestal system and the hanger bracket and a first step of assembly thereof.
Figure 11D:
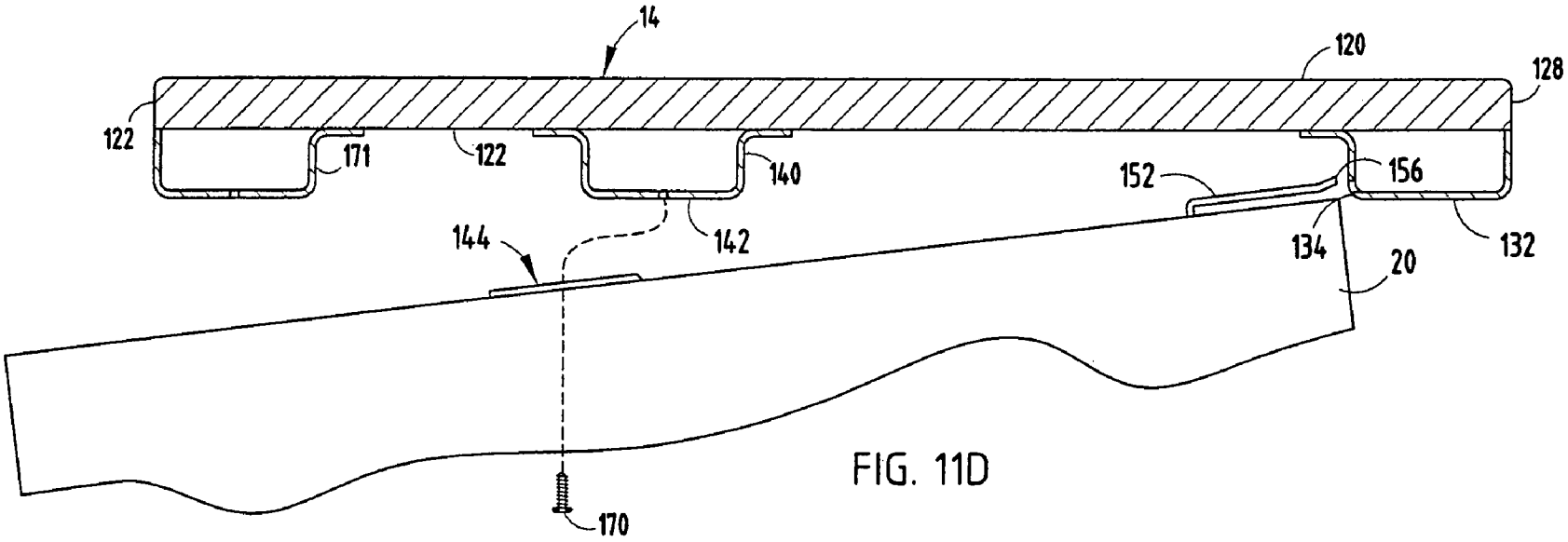
FIG. 11D is a side view of the pedestal system being assembled with the worksurface, wherein rear support arms of the hanger bracket is slidably received within a first support bracket.
Figure 11E:
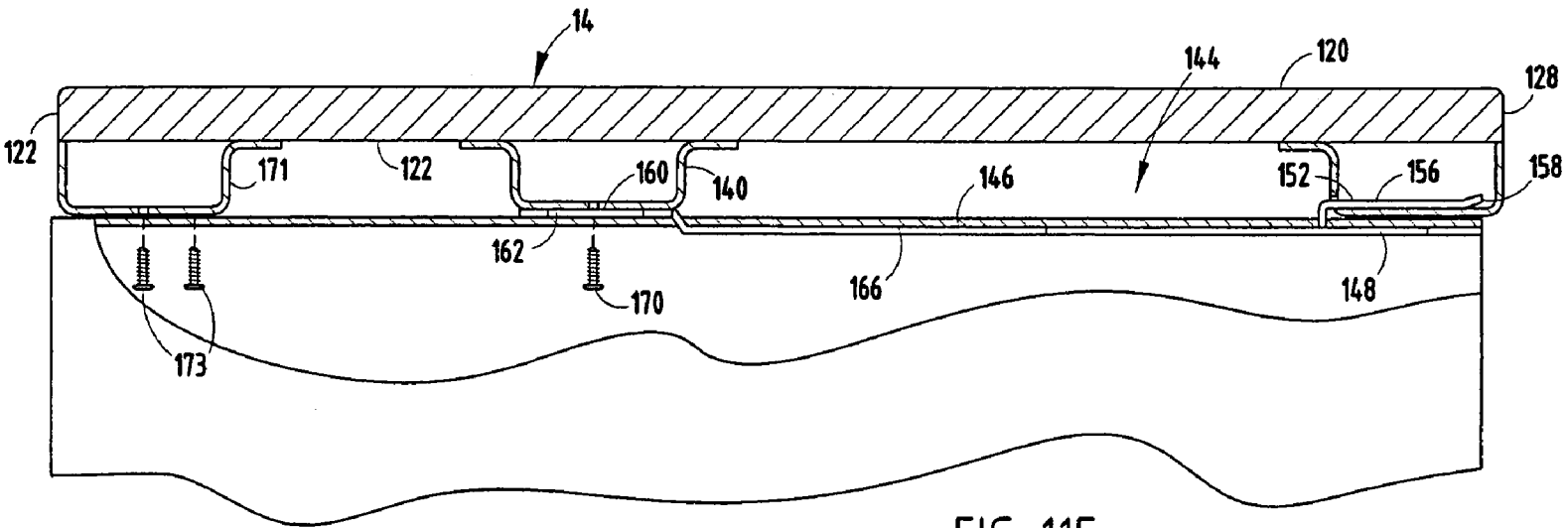
FIG. 11E is a side view of the pedestal system being assembled with the worksurface, wherein a forward portion of the hanger bracket is coupled with a second support beam.

In assembly, as best illustrated in FIGS. 11A-11E, the connection plate 144 is placed in a substantially vertical position with respect to the pedestal assembly 16 and is lowered and rotated in position such that the flanges 30 of each sidewall 20 are received within the reliefs 166 of the connection plate 144 (FIG. 11A). The connection plate 144 is then vertically and horizontally rotated such that the flanges 30 of the sidewalls 20 are positioned between the support arms 148 and the tabs 162 of the connection plate 144 (FIG. 11B). The connection plate 144 is then slid rearwardly until the rear structural member 34 is located within the gap 154 of the connection plate 144 and between the support arms 148 and the engagement member 152 (FIG. 11C). It should be noted that the support arms 148 and the engagement member 152 are configured such that a gap 154 remains between the engagement member 152 and the rear structural member 34 of the pedestal system 16. The connection plate 144 is then secured to the pedestal system 16 by a plurality of mechanical fasteners such as screws 168 that extend through apertures 35 of the rear structural member 34 and into the apertures 150 of the connection plate 144. The pedestal system 16 and the connection plate 144 are positioned beneath the worksurface 114 such that the support flange 138 of the first support bracket 132 is received into the gap 154 between the engagement member 152 and the support arms 148 of the connection plate 144 (FIG. 11D). The pedestal system 16 is then rotated upwardly until the forward portion 160 of the connection plate 144 is proximate the second support bracket 140, and mechanical fasteners such as screws 170 are inserted into the apertures 164 of the connection plate 144 and are received within the apertures 142 of the second mounting bracket 140, thereby securely fastening the connection plate 144 to the bottom surface 122 of the worksurface 14 and supporting the pedestal system 16 from the worksurface 14 (FIG. 11E). Alternatively, a third mounting bracket 171 (FIGS. 11D and 11E) is secured to the bottom 122 of the worksurface 14 proximate the front edge 126. A plurality of screws 173 are then used to secure the pedestal system 16 to the worksurface 14 by extending the screw 173 through the front structural member 36 and into the third mounting bracket 171.

Figure 12:
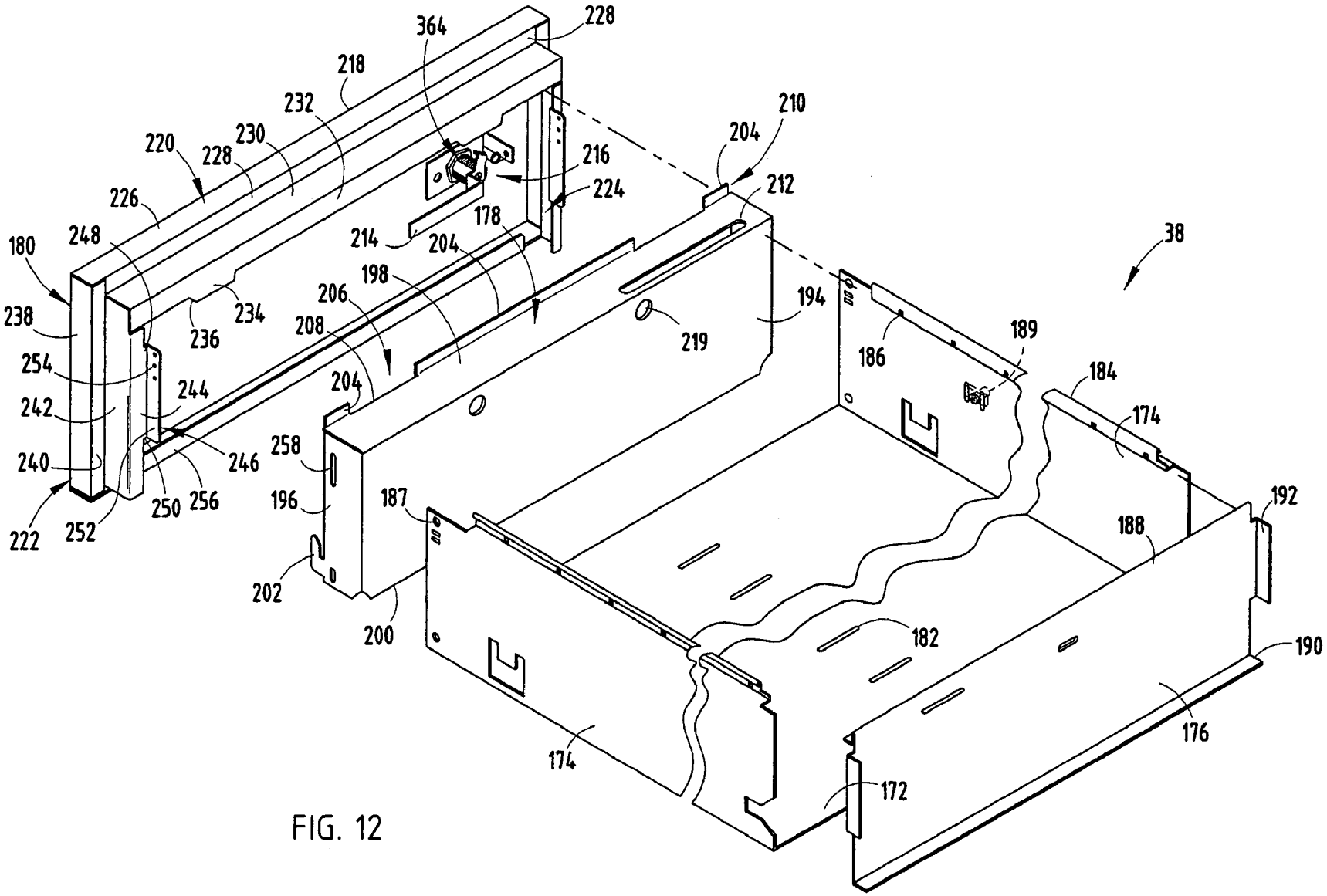
FIG. 12 is an exploded rear perspective view of the drawer assembly.

Each drawer assembly 38 (FIG. 12) includes a bottom wall 172 integrally formed with a pair of sidewalls 174 that extend orthogonally upwardly from and are opposed across the bottom wall 172 from one another, a rear wall 176 that extends orthogonally upwardly from the bottom wall 172 and between the sidewalls 174, a front wall 178 that extends orthogonally upwardly from the bottom wall 172 and between the sidewalls 174, and a face plate 180 that is operably coupled with the front wall 178. The bottom wall 172 includes a plurality of centrally-located, laterally-extending and longitudinally-aligned slots 182 extending therethrough. Each sidewall 174 includes an integrally formed and longitudinally-extending rail 184 located along an upper edge thereof. Each rail 184 includes a plurality of apertures 186 spaced along the length thereof. A drawer actuator pin 189 is fixedly connected to and extends outwardly from one of the sidewalls 174. The rear wall 176 includes a rail 188 extending along the length thereof and located proximate an uppermost edge thereof. The rear wall 176 further includes a bottom flange 190 and a pair of side flanges 192 that are affixed to the bottom wall 172 and the sidewalls 174 by spot welding, thereby affixing the rear wall 176 with the bottom wall 172 and sidewalls 174, respectively.

The front wall 178 is rectangularly-box shaped and includes a rear surface 194, and a pair of side surfaces 196, a top surface 198 and a bottom surface 200 each extending forwardly from and orthogonally to the rear surface 194. The front wall 178 is formed of a single piece of shaped sheet metal, however, other materials suitable for such application may be substituted therefore. The side surfaces 196 and the bottom surface 200 of the front wall 178 are secured to the sidewalls 174 and the bottom wall 172 of the drawer assembly 38, respectively, by way of spot welding, and the like. The front wall 178 further includes a pair of upwardly-disposed hook members 202 extending forwardly from and integrally formed with the side surfaces 196. In the illustrated example, the hook members 202 are located proximate the bottom surface 200 of the front wall 178. The front wall 178 further includes a plurality of laterally and upwardly-extending tabs 204 integrally formed with the top surface 198. The tabs 204 are laterally spaced across the front wall 178 so as to define gaps 206 therebetween. Each gap 206 is partially defined by a recess 208 extending rearwardly from the tabs 204 and into the top surface 198. The tabs 204 cooperate to form a flange 210 extending laterally across an upper edge of the front wall 178. The top surface 198 of the front wall 178 further includes a laterally-extending slot 212 for receiving the actuator arm 214 of a lock mechanism therethrough, as discussed below.

The face plate 180 includes an aesthetic front surface 218, a stepped top surface 220, stepped side surfaces 222 and a bottom surface 224. The front surface 218 is provided with an aesthetic cover of paint, fabric, or other finish as desired by the end user. The top surface 220 includes a first section 226 extending rearwardly from and orthogonally to the front surface 218, a step section 228 extending downwardly from and orthogonal to the first section 226, and a second section 230 extending rearwardly from and orthogonally to the step section 228. A laterally-extending flange 232 is integrally formed with the second section 230 and extends downwardly from and orthogonally to the second section 230. The flange 232 includes a pair of downwardly-extending and spaced-apart tabs 234 each having tapered sidewalls 236. The tabs 234 are located so as to align with the gaps 206 and the recesses 208 of the front wall 178, as described below. Each side surfaces 222 includes a first section 238 extending rearwardly from and orthogonally to the front surface 218, a step section 240 extending inwardly from and orthogonally to the first section 238, a second section 242 extending rearwardly from and orthogonally to the first step section 240, and a second step section 244 extending inwardly from and orthogonally to the second section 242. An L-shaped tab member 246 is integrally formed with and extends inwardly from an orthogonal to the second step section 244. The tab member 246 includes a first portion 248 that is substantially planar with the second step section 244 and that includes an abutment wall 250 along the lower edge thereof, and a second portion 252 extending orthogonally to and rearwardly from the first portion 248 and having a plurality of apertures 254 spaced therealong. A flange 256 extends longitudinally along, upwardly from and orthogonally to the bottom surface 224.

Figure 13:
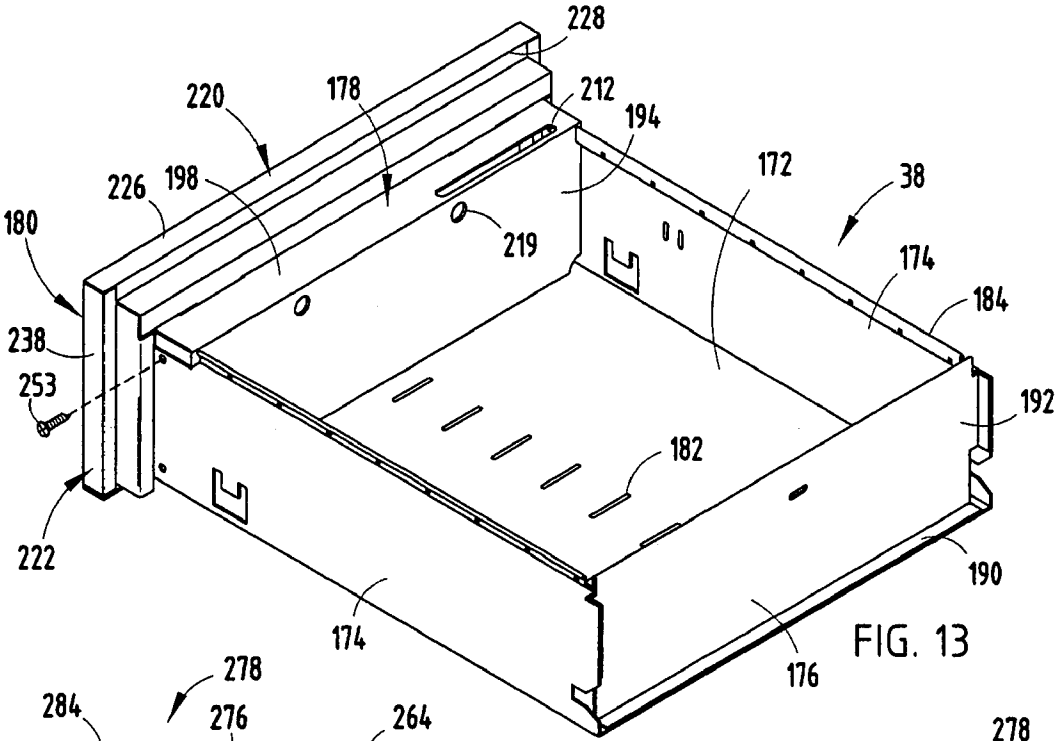
FIG. 13 is a rear perspective view of a face plate assembled with a front wall of the drawer assembly.

In assembly, the face plate 180 (FIGS. 12 and 13) is aligned with the sidewalls 174 of the drawer assembly 38, such that the second portion 252 of each tab member 246 is located inwardly of the side surfaces 196 of the front wall 178, and further such that the abutment wall 250 of each tab member 246 is located upwardly from the hook members 202. The face plate 180 is then moved inwardly toward the front wall 178 until the tabs 234 are vertically aligned with the gaps 206 and the recesses 208 of the front wall 178. The face place 180 is then lowered with respect to the front wall 178 until the tabs 234 are received within the gaps 206 and the recesses 208 of the front wall 178, the tabs 204 of the front wall 178 are located in front of the flange 232 of the face plate 180, and the abutment walls 250 are received within the hook members 202, thereby coupling the face plate 180 with the front wall 178. A plurality of screws 253 are then placed through apertures 187 of the sidewalls 174 and are threadably received into apertures 254 of the face plate 180, thereby securely fastening the face plate 180 to the front wall 178.

Figure 14:
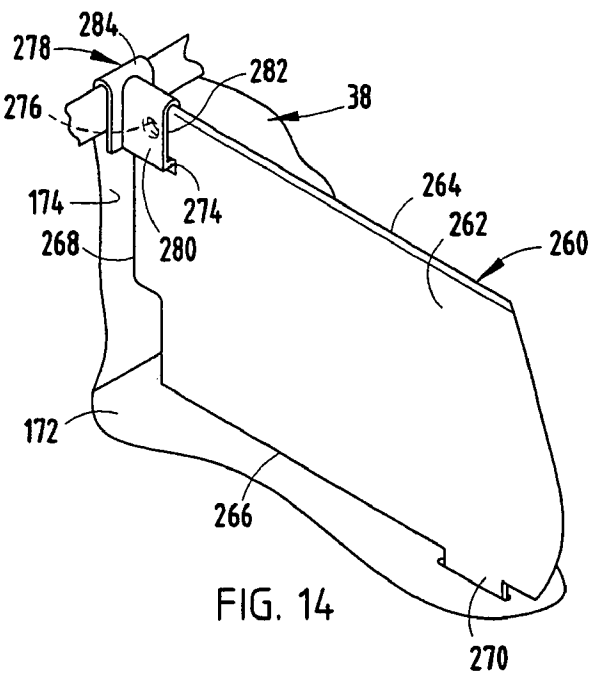
FIG. 14 is a perspective view of the drawer divider supported within the drawer assembly.
Figure 17:
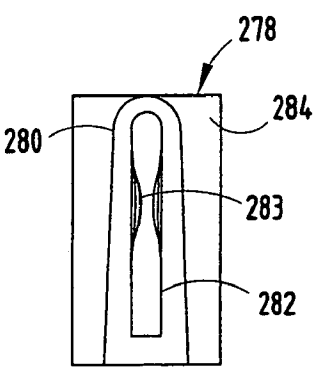
FIG. 17 is a side view of the hanger member.
Figure 16:
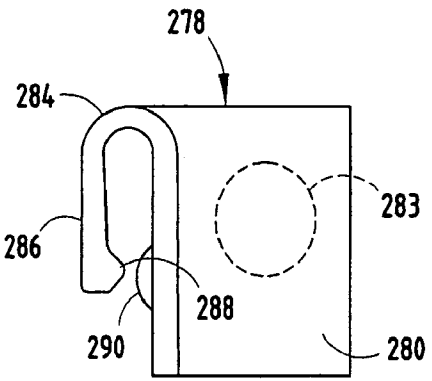
FIG. 16 is a front view of a hanger member of the drawer divider.
Figure 15:
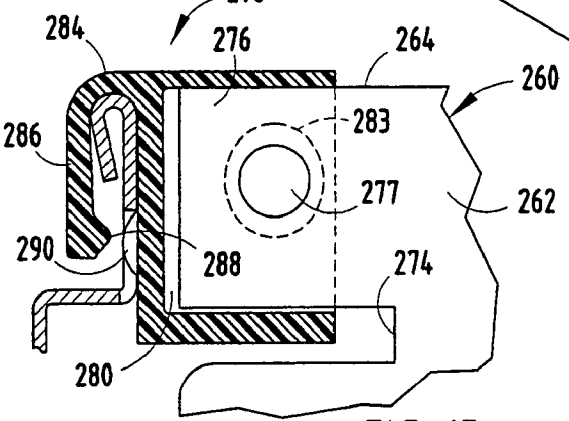
FIG. 15 is a front cross-sectional view of the drawer divider located within the drawer assembly.

A drawer divider 260 (FIGS. 2 and 14) is provided to subdivide the interior space 44 of each drawer assembly 38. The drawer divider 260 includes a planar body portion 262 having a top edge 264, a bottom edge 266 and side edges 268. The bottom edge 266 includes a centrally-located and downwardly-extending tab 270. A notch 274 extends inwardly from each side edge 268, thereby defining a tab 276 on each side of the body portion 262. Each tab 276 includes an aperture 272 extending therethrough. The drawer divider 260 further includes a pair of hook-shaped engagement or hanger members 278 (FIGS. 15-17) each having a sleeve 280 defining a pocket 282 therein and a hook-shaped portion 284 extending outwardly from the sleeve 280. A pair of inwardly-extending tabs 283 are located within the pocket 282 of the sleeve 280 and engage the apertures 277 of the tabs 276. The hook-shaped portion 284 includes a flexibly resilient and outwardly-extending arm portion 286 having a knob 288 located at an end thereof. Each hanger member 278 includes a semi-circularly shaped tab 290 extending outwardly towards the arm portion 286.

In assembly, the drawer divider 260 is placed within the interior space 44 of the drawer assembly 38 such that the tab 270 is received within one of the slots 182 of the bottom wall 172, and further such that the tabs 290 are received within corresponding apertures 186 of the sidewalls 174, thereby positively locating the drawer divider 260 within the drawer assembly 38 and subdividing the interior space 44. The simultaneous engagement of the bottom tab 270 and the side tabs 290 with the drawer assembly 38 prevents any tipping or rotation of the divider 260 with respect to the drawer assembly 38. When assembled, the arm portions 286 of the hanger members 278 bias the knobs 288 into engagement with the rails 184 of the sidewalls 174 and the tabs 290 into engagement within the apertures 186 of the sidewalls 174.

Figure 19:
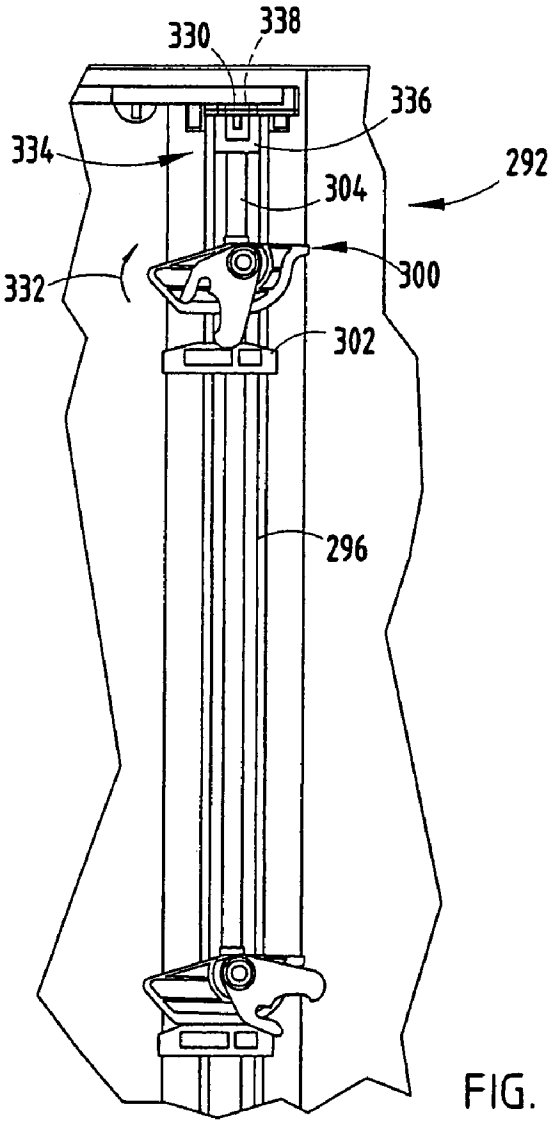
FIG. 19 is a side view of the lock/interlock assembly.
Figure 18:
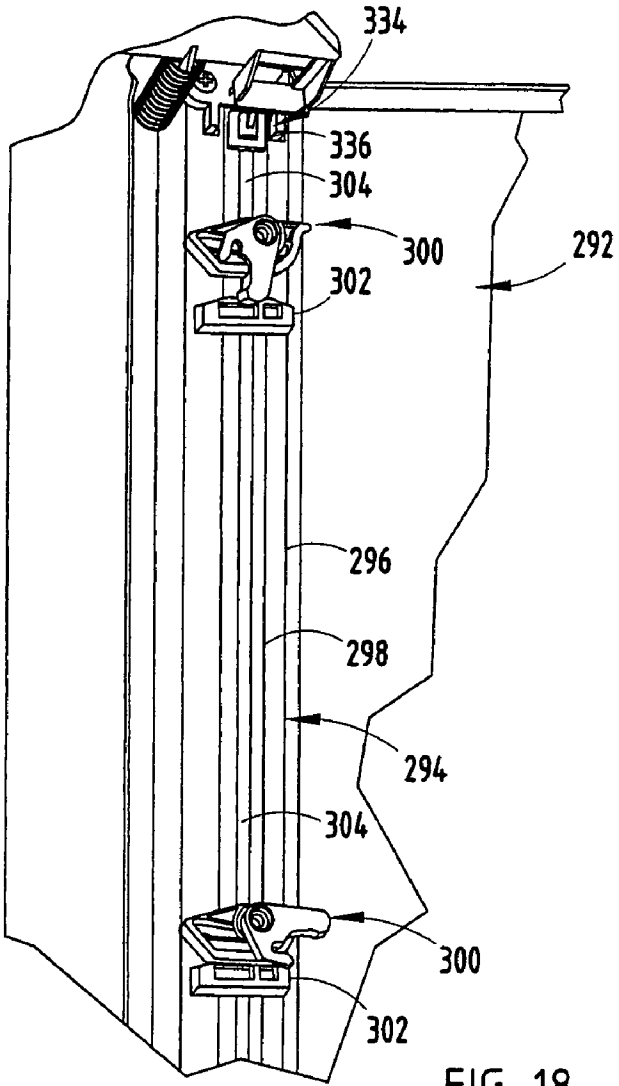
FIG. 18 is a front perspective view of a lock/interlock assembly supported within the housing.

The pedestal system 16 further includes a lock/interlock system 292 (FIGS. 18 and 19) for locking the drawer assemblies 38 in a closed position, as well as for interlocking the actuation of the drawer assemblies 38 to one another. The lock/interlock system 292 includes a lock/interlock assembly 294 secured to the interior surface 21 of at least one of the sidewalls 20. The lock/interlock 294 includes a guide member 296 having a longitudinally-extending C-shaped channel 298 having a finite operable length, a plurality of cam assemblies 300 slidably coupled with the channel 298, a plurality of stop members 302 slidably coupled with the channel 298 and interspaced with the cam assemblies 300, and a plurality of lift bars 304 slidably received within the channel 298 and interspaced with the cam assemblies 300 and the stop members 302.

Figure 21:
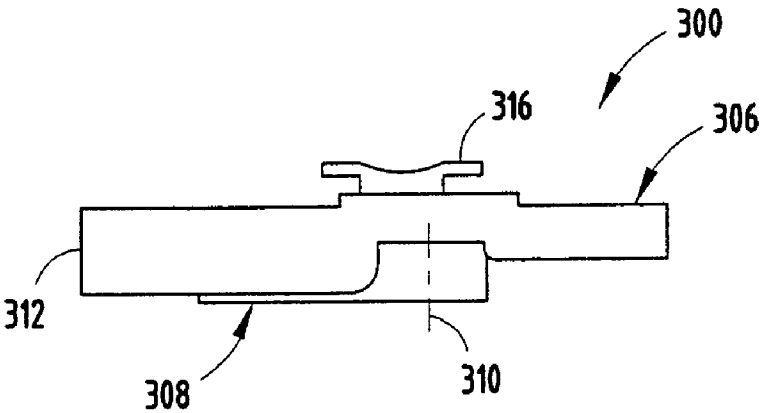
FIG. 21 is a top view of the cam lifter.
Figure 20:
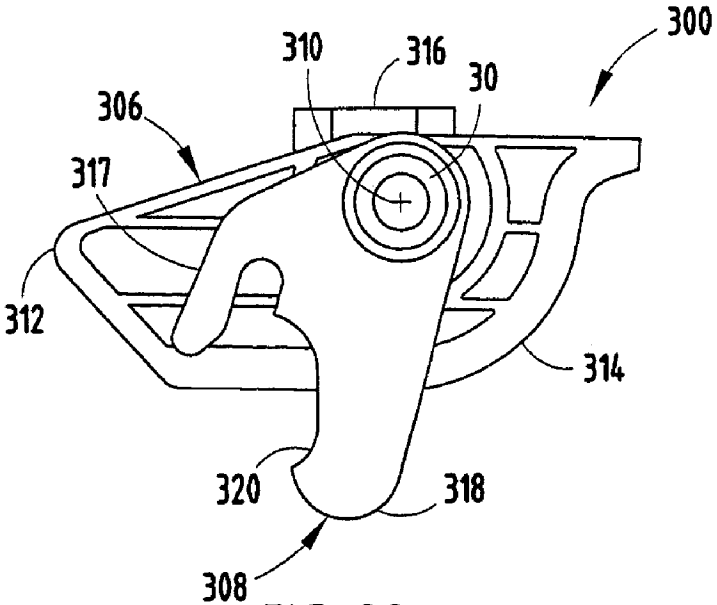
FIG. 20 is a side view of a cam lifter of the lock/interlock assembly.

Each cam assembly 300 (FIGS. 20 and 21) includes a slide member 306, and a cam member 308 pivotally coupled to the slide member 306 at a pivot point 310. The slide member 306 includes a main body portion 312 having an arcuately-shaped leading edge 314, and a T-shaped slide portion 316 that is slidably received within the channel 298. The cam member 308 includes a first cam surface 317 and a second cam surface 318 divided by a pin receiving, arcuately-shaped pocket 320, and wherein the distance between the second cam surface 318 and the pivot point 310 is greater than the distance between the first cam surface 317 and the pivot point 310. It should be noted that the radius of the curve formed by the leading edge 314 remains constant with respect to the pivot point 310.

Figure 23:
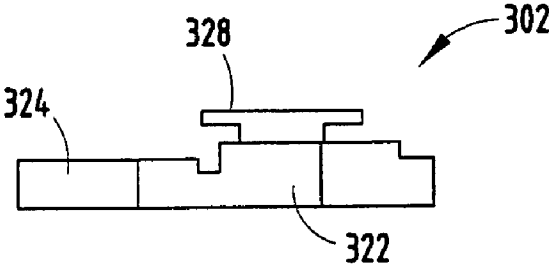
FIG. 23 is a top view of the stop member.
Figure 22:
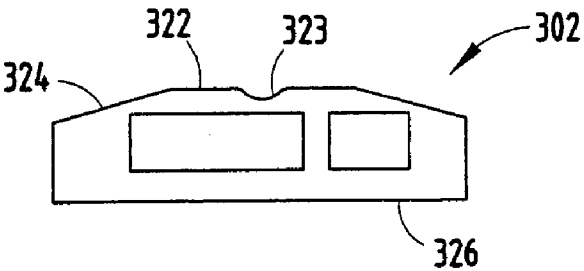
FIG. 22 is a side view of a stop member of the lock/interlock assembly.

Each stop member 302 (FIGS. 22 and 23) includes a first abutment surface 322 having a recess 323, a second abutment surface 324 angled with respect to the first abutment surface 322, and a bottom surface 326. Each stop member 302 further includes a rearwardly-extending T-shaped slide portion 328 slidably received within the channel 298.

In operation, the first cam surface 317 of each cam assembly 300 abuts the second abutment surface 324 of the associated stop member 302 when the corresponding drawer assembly is in the closed position. A coil spring 330 is located within the channel 298 at an uppermost portion thereof, and functions to resiliently force the cam assemblies 300, stop members 302 and lift bars 304 downwardly within the guide member 296. When a drawer assembly 38 is slidably moved from the closed position to an open position, the pin member 189 associated with that drawer assembly 38 is received within the pocket 320 of the cam member 308 and abuts the leading edge 314 of the slide member 306, thereby pivoting the cam member 308 in a direction as indicated by directional arrow 332, such that the second cam surface 318 is rotated into engagement within the recess 323 of the first cam surface 16 of the associated stop member 302, and the cam assembly 300 is moved upwardly within the channel 298 as the pin 189 guides along the leading edge 314 of the slide member 306. The slide portion 316 of the slide member 306 abuts the lift bar or rod 304 located directly above, which in turn acts on any stop member 302 and cam assembly 300 located above that point. The cam assemblies 300, stop members 302 and lift bars 304 located above the lift point are allowed to move upwardly closing the gap 334 as defined between a first stop member 336 slidably received within the channel 298, and a second stop member 338 fixedly received within an end of the channel 298. Subsequent opening of additional drawer assemblies 38 is prevented as the gap 334 is completely closed by the opening of the first drawer assembly 338 and the resulting movement of the associated lock/interlock assembly 294, thereby prohibiting the movement of any additional cam assemblies 300.

Figure 25:
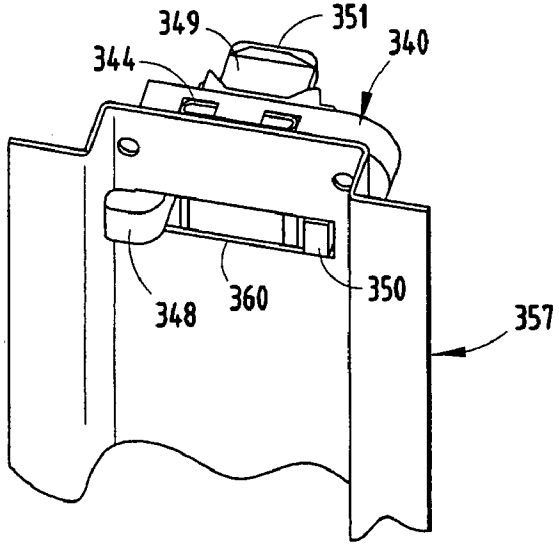
FIG. 25 is an enlarged rear perspective view of the top connector mounted within the housing.
Figure 27:
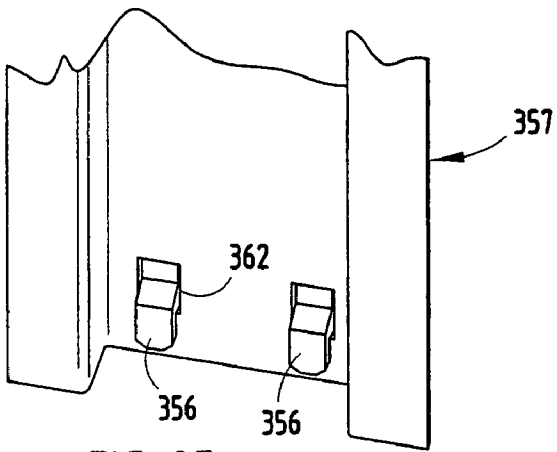
FIG. 27 is an enlarged rear perspective view of the bottom connector mounted within the housing.
Figure 24:
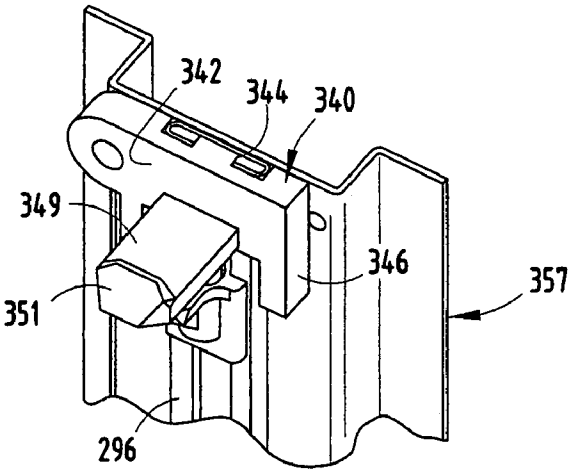
FIG. 24 is an enlarged front perspective view of a top connector of the lock/interlock assembly mounted within the housing.
Figure 26:
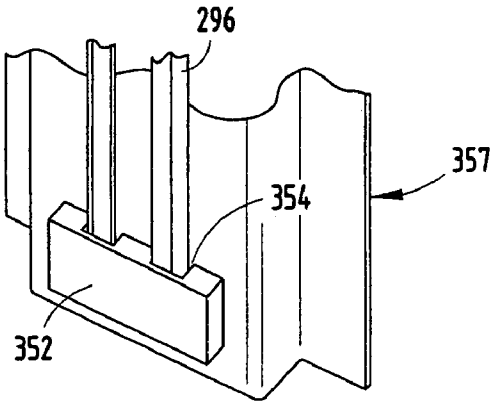
FIG. 26 is an enlarged front perspective view of a bottom connector of the lock/interlock assembly mounted within the housing.
Figure 28:
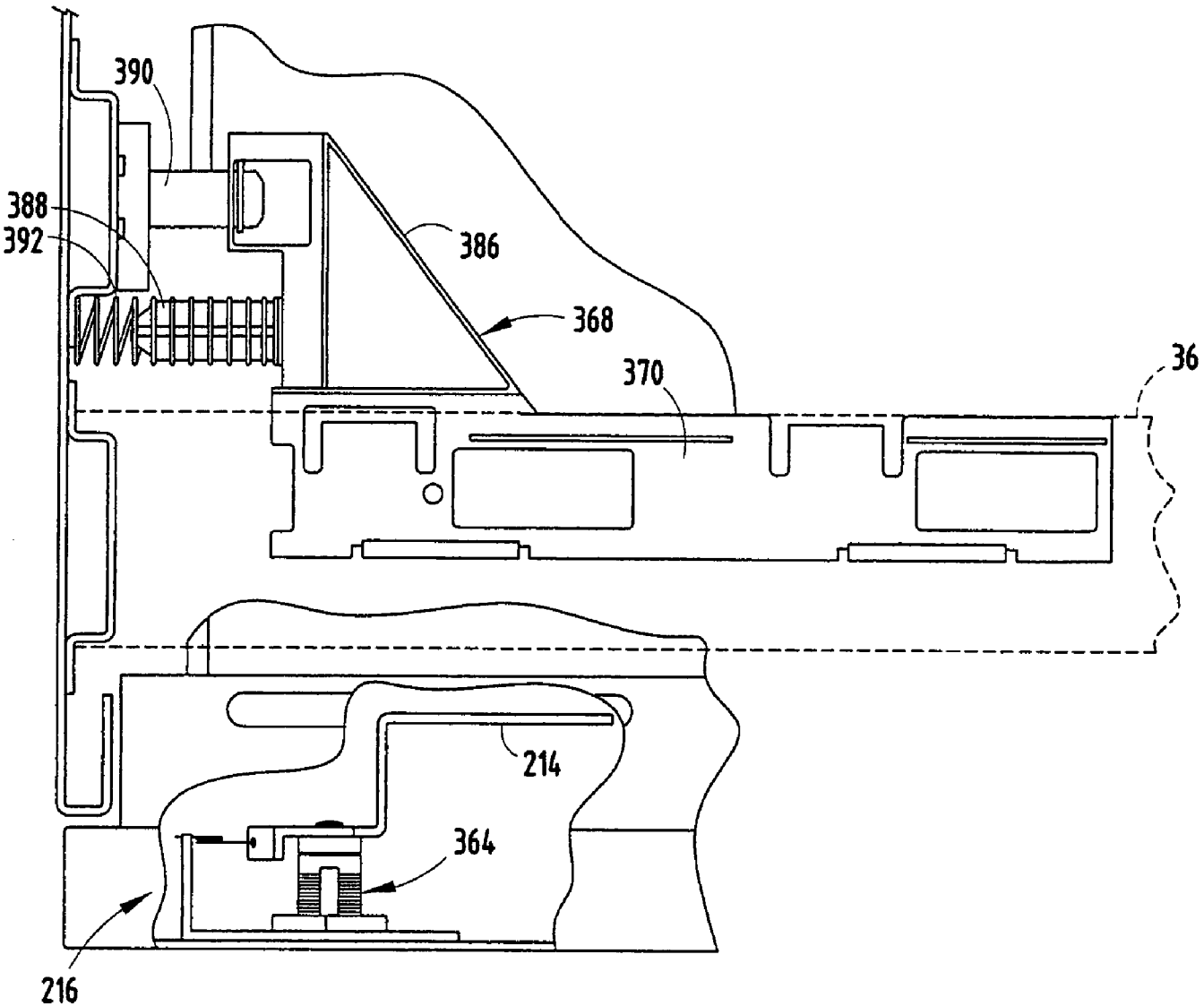
FIG. 28 is a top cross-sectional view of the lock actuator mounted within the housing.
Figure 29:
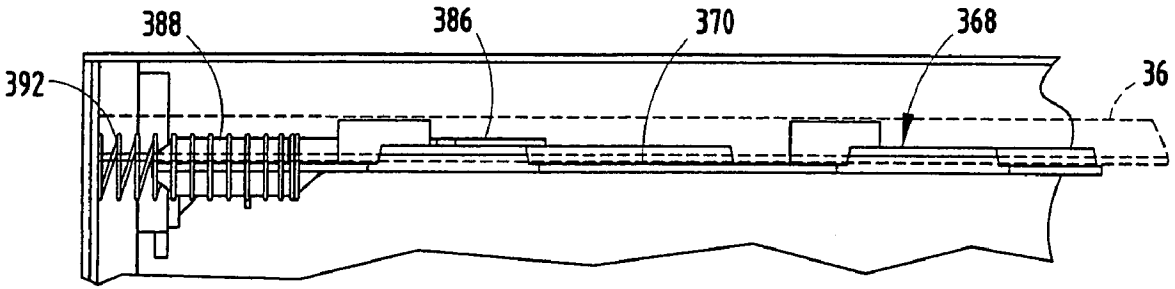
FIG. 29 is a front cross-sectional view of the actuator mounted within the housing.
Figure 30:
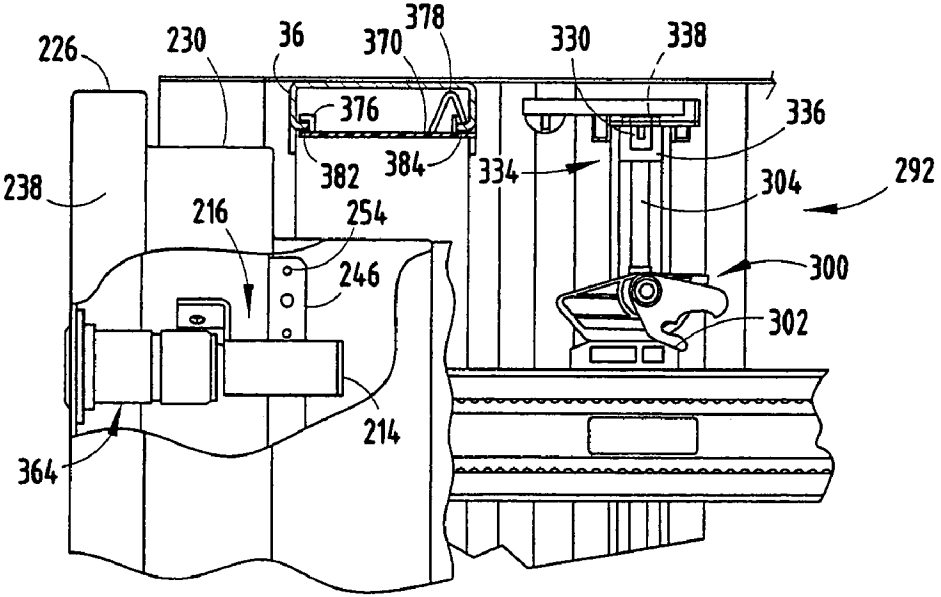
FIG. 30 is an end cross-sectional view of the lock actuator mounted within the housing.
Figure 31:
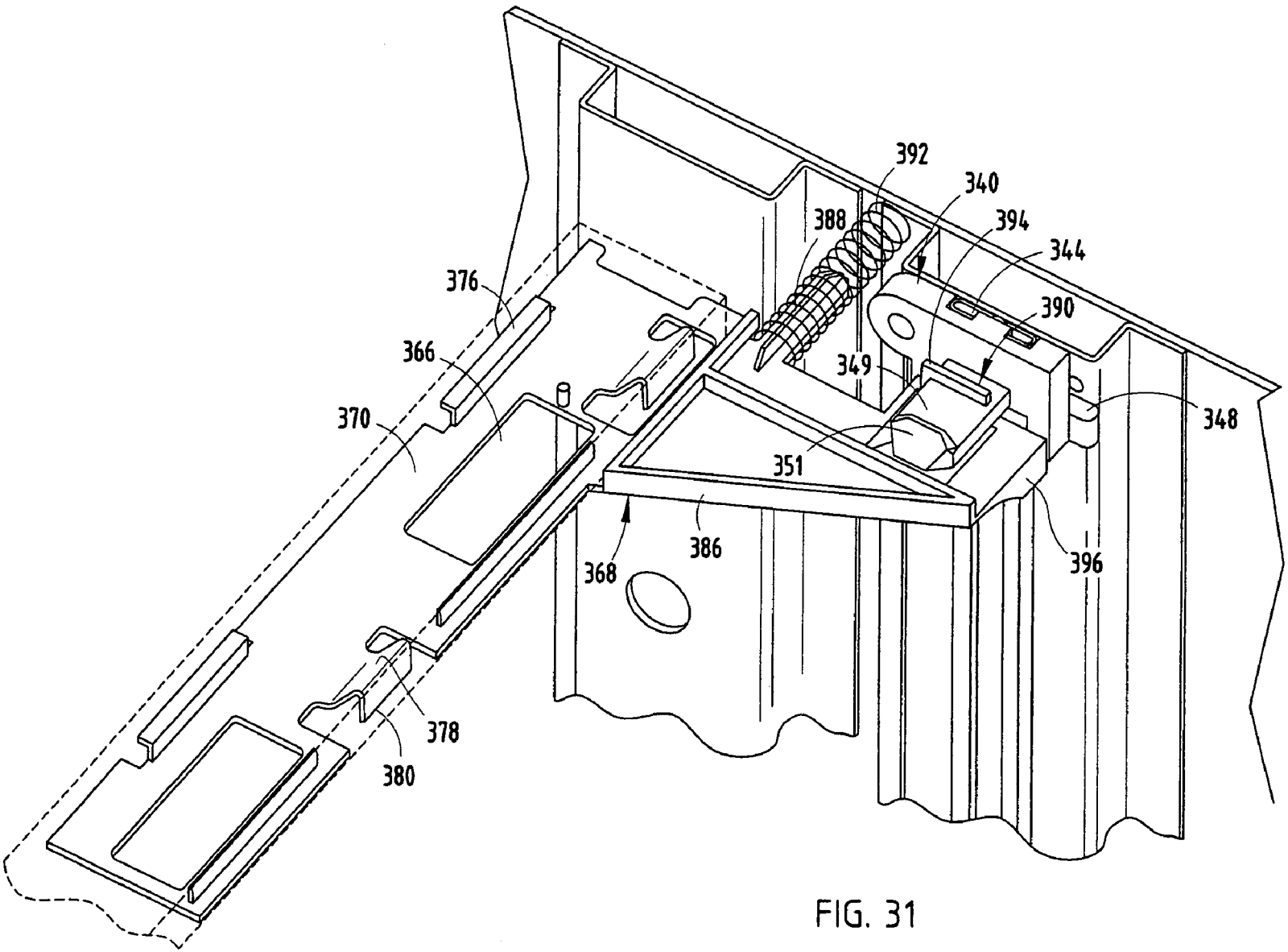
FIG. 31 is a top cross-sectional perspective view of the lock actuator connected to the lock/interlock assembly.

An attachment assembly for mounting the lock/interlock system 292 within the interior space 24 of the housing 17 includes a top connector member 340 (FIGS. 24 and 25) having a body portion 342, a pair of rearwardly-disposed channels 344 for receiving the guide member 296 therein, a pair of downwardly-extending legs 346 that guide along the edge of the guide member 296, a rearwardly-extending L-shaped first tab 348, and a rearwardly-extending second tab 350 spaced apart from the first tab 348. The top connector member 340 further includes a forwardly-extending guide arm 349 having an upwardly-extending prong 351 located at a distal end thereof. The attachment assembly further includes a rectangularly-shaped bottom connector member 352 (FIGS. 26 and 27) having a pair of channels 354 extending therethrough for receiving the guide member 296 therein. The bottom connector member 352 also includes a pair of downwardly-opening, rearwardly-extending and laterally-spaced hooks 356.

In assembly, a hat-shaped upright 357 is attached to the interior surface 21 of one of the sidewalls 20 by way of welding, an adhesive or the like. The upright 357 includes a first laterally-extending, rectangularly-shaped aperture 360 located near an upper end thereof, and a pair of laterally spaced-apart square-shaped apertures 362 located near a lower end thereof. The bottom connector member 352 is coupled with the upright 357 by inserting the hooks 356 into the apertures 362. The lower end of the guide member 296 of the lock/interlock system 292 is then placed within the channels 354 of the bottom connector member 352. The top connector member 340 is then aligned with the top of the guide member 296 of the lock/interlock system 292, and the guide member 296 is slightly rotated such that the first tab 348 of the top connector member 340 can be inserted into the aperture 360 of the upright 358. Subsequent to the first tab 348 being slid into position within the aperture 360 of the upright 357, the guide member 296 is rotated and pressed inwardly toward the upright 357, such that the second tab 350 is closely received within the aperture 360, thereby preventing disengagement of the first tab 348 from within the aperture 360 and securely coupling the lock/interlock system 292 within the interior space 24 of the housing 17.

The lock mechanism 216 (FIGS. 12) includes a key-actuated tumbler assembly 364 mounted within the face plate 180 and in operable communication with the actuator arm 214. The actuator arm 214 is received within a slot 366 of a locking arm 368 that is slidably coupled within the front structural member 36 of the housing 17. The locking arm 368 (FIGS. 28-31) includes a body portion 370 having a forwardly-extending channel 376, and an upwardly-extending, inverted V-shaped, flexibly resilient prong 378 having a free end 380. In assembly, the locking arm 368 is slidably coupled with the C-shaped front structural member 36 by locating the channel 376 of the locking arm 368 about a first channel 382 of the front structural member 36 and pressing the locking arm 368 upwardly toward the front structural member 36, thereby forcing the prong 378 past a second flange 384 of the front structural member 36.

The locking arm 368 further includes a rearwardly-extending, triangularly-shaped arm 386, a spring receiver 388 extending outwardly from the arm 386, and a coupling loop 390. The spring receiver 388 receives a coil spring 392 thereabout that is biased between the arm 386 and the associated sidewall 20 of the housing 17, thereby biasing the locking arm 368 toward an unlocked position. The coupling loop 390 includes a retention member 394 and a stop member 396 that cooperate to form a broken loop. In assembly, the guide arm 349 of the top connector member 340 is slidably received within the coupling loop 390 such that the retention member 394 extends above the guide arm 349 and the stop member 396 is located below the guide arm 349.

In operation, the tumbler assembly 364 is key-actuated between a locked position, and an unlocked position. In a locked position the actuator arm 214 rotates in a clockwise direction about the tumbler assembly 364 and forces the locking arm 368 to slide overcoming the biasing force as exerted thereon by the coil spring 392 and such that the stop member 396 of the locking arm 368 is located within the gap 334 of the lock/interlock system 292, thereby preventing any of the components of the lock/interlock assembly 294 from sliding within the guide member 296 and effectively locking each and every drawer assembly 38 in the closed position within the housing 17. In an unlocked position the tumbler assembly is key-actuated in a clockwise direction, such that the biasing force of the coil spring 392 biases the locking arm 368 in a direction away from the lock/interlock system 292, thereby removing the stop member 396 from within the gap 334 an allowing the drawer assemblies 38 to be moved to the open position.

The present inventive pedestal system includes assemblies and subsystems that may be utilized within a wide variety of storage systems, are relatively inexpensive to manufacture, and may be assembled/disassembled without the use of specialized tools and/or skilled personnel. Moreover, the pedestal system disclosed herein are efficient in assembly/disassembly as well as in use, is capable of a long-operating life, and is particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A drawer assembly, comprising:

a bottom wall;

a pair of sidewalls opposed across the bottom wall from one another and extending upwardly from the bottom wall;

a rear wall extending upwardly from the bottom wall and between the pair of sidewalls;

a front wall extending upwardly from the bottom wall between the pair of sidewalls and opposed across the bottom wall from the rear wall, the front wall including at least one laterally extending flange located proximate an uppermost edge thereof; and a face plate having at least one laterally extending flange located substantially proximate an upper edge thereof;

wherein at least a select one of a group consisting of the at least one flange of the front wall and of the at least one flange of the face plate includes a pair of flanges laterally offset from one another and defining a first gap therebetween, wherein the at least select one of the at least one flange of the front wall and the at least one flange of the face plate is laterally spaced from an outermost edge of the perspective front wall or face plate, and wherein the remaining one of the group consisting of the at least one flange of the front wall and the at least one flange of the face plate includes an outwardly extending first tab that is received into the gap, thereby coupling the face plate with the front wall.

2. The drawer assembly of claim 1, wherein the face plate further includes a pair of side tabs extending longitudinally along side edges of the face plate, and wherein the side tabs are secured to the sidewalls.

3. The drawer assembly of claim 2, wherein the side tabs of the face plate are located inwardly of the sidewalls.

4. The drawer assembly of claim 1, wherein the front wall includes a pair of tab members extending forwardly from the side edges of the front wall, and wherein the tab members engage abutment surfaces of the face plate, thereby supporting the face plate from the front wall.

5. The drawer assembly of claim 4, wherein the tab members of the front wall are hook-shaped, thereby coupling the face plate with the front wall.

6. The drawer assembly of claim 1, further including:

a locking mechanism operably mounted to the front wall and extending outwardly through a front surface of the face plate.

7. A drawer assembly, comprising:

a bottom wall;

a pair of sidewalls opposed across the bottom wall from one another and extending upwardly from the bottom wall;

a rear wall extending upwardly from the bottom wall and between the pair of sidewalls;

a front wall extending upwardly from the bottom wall between the pair of sidewalls and opposed across the bottom wall from the rear wall, the front wall including at least one laterally extending flange located proximate an uppermost edge thereof; and a face plate having at least one laterally extending flange located substantially proximate an upper edge thereof;

wherein at least a select one of a group consisting of the at least one flange of the front wall and of the at least one flange of the face plate includes a pair of flanges defining a first gap therebetween, and wherein the remaining one of the group consisting of the at least one flange of the front wall and the at least one flange of the face plate includes an outwardly extending first tab that is received into the gap, thereby coupling the face plate with the front wall; and wherein the at least one flange of the front wall includes three upwardly extending flanges cooperating to define the first gap and a second gap therebetween, the face plate includes the first tab and a second tab each extending downwardly, and wherein the first tab is received within the first gap and the second tab is received within the second gap.

8. The drawer assembly of claim 7, wherein the first and second gaps extend inwardly from the at least one flange of the front wall.

9. The drawer assembly of claim 8, wherein each tab includes tapered side edges.

10. The drawer assembly of claim 9, wherein the face plate further includes a pair of side tabs extending longitudinally along side edges of the face plate, and wherein the side tabs are secured to the sidewalls.

11. The drawer assembly of claim 10, wherein the side tabs of the face plate are located inwardly of the sidewalls.

12. The drawer assembly of claim 11, wherein the front wall includes a pair of tab members extending forwardly from side edges of the front wall, and wherein the tab members engage abutment surfaces of the face plate, thereby supporting the face plate from the front wall.

13. The drawer assembly of claim 12, wherein the tab members of the front wall are hook-shaped, thereby coupling the face plate with the front wall.

14. A drawer assembly, comprising:

a bottom wall;

a pair of sidewalls opposed across the bottom wall from one another and extending upwardly from the bottom wall;

a rear wall extending upwardly from the bottom wall and between the pair of sidewall;

a front wall extending upwardly from the bottom wall between the pair of sidewalls and opposed across the bottom wall from the rear wall, the front wall including at least one laterally extending flange located proximate an uppermost edge thereof, and at least one forwardly extending tab located along a side edge of the front wall; and a face plate having at least one laterally extending flange located substantially proximate an upper edge thereof, and a rearwardly exposed abutment surface;

wherein the flange of the front wall and the flange of the face plate engage one another, and wherein the at least one tab of the front wall engages the abutment surface of the face plate, thereby coupling the face plate with the front wall, the front wall is adapted to be secured to the pair of sidewalls prior to the face plate being secured to the front wall, the face plate further including at least one side tab extending longitudinally along a side edge of the face plate, the at least one side tab is secured to one of the sidewalls, the at least one side tab of the face plate is located inwardly of the sidewalls, the at least one tab of the front wall is hook-shaped, and wherein the at least one tab of the front wall engages the at least one side tab of the face plate.

15. The drawer assembly of claim 14, further including:

a locking mechanism operably mounted to the front wall and extending outwardly through a front surface of the face plate.

16. A drawer assembly, comprising:

a bottom wall;

a pair of sidewalls opposed across the bottom wall from one another and extending upwardly from the bottom wall;

a rear wall extending upwardly from the bottom wall and between the pair of sidewalls;

a front wall extending upwardly from the bottom wall between the pair of sidewalls and opposed across the bottom wall from the rear wall, the front wall including at least one laterally extending flange located proximate an uppermost edge thereof, and forwardly extending tab members located along side edges of the front wall; and a face plate having at least one laterally extending flange located substantially proximate an upper edge thereof, and rearwardly exposed abutment surfaces;

wherein the flange of the front wall and the flange of the face plate engage one another, the tab members of the front wall engage the abutment surfaces of the face plate, thereby coupling the face plate with the front wall, the front wall is adapted to be secured to the pair of sidewalls prior to the face place being secured to the front wall, the face plate further includes a pair of side tabs extending longitudinally along side edges of the face plate, the side tabs are secured to the sidewalls, the tab members of the front wall are hook-shaped and wherein the tab members of the front wall engage the side tabs of the face plate.

17. The drawer assembly of claim 16, further including:

a locking mechanism operably mounted to the front wall and extending outwardly through a front surface of the face plate.

18. A storage cabinet, comprising:

a housing member including a pair of sidewalls, a rear wall and a bottom wall cooperating to define an interior space and a forwardly facing aperture providing access to the interior space; and at least one drawer assembly operably coupled to the housing member within the aperture for rectilinear movement into and from the interior of the housing member, the at least one drawer assembly comprising:

a bottom wall;

a pair of sidewalls opposed across the bottom wall of the at least one drawer assembly from one another and extending upwardly from the bottom wall of the at least one drawer assembly;

a rear wall extending upwardly from the bottom wall of the at least drawer assembly and between the pair of sidewalls of the at least one drawer assembly;

a front wall extending upwardly from the bottom wall of the at least one drawer assembly between the pair of sidewalls of the at least one drawer assembly and opposed across the bottom wall of the at least one drawer assembly from the rear wall of the at least one drawer assembly, the front wall including at least one laterally extending flange located proximate an uppermost edge thereof; and a face plate having at least one laterally extending flange located substantially proximate an upper edge thereof;

wherein at least a select one of a group consisting of the at least one flange of the front wall of the at least one drawer assembly and of the at least one flange of the face plate includes a pair of flanges laterally offset from one another and defining a first gap therebetween, wherein the at least select one of the at least one flange of the front wall and the at least one flange of the face plate is laterally spaced from an outermost edge of the perspective front wall or face plate, and wherein the remaining one of the group consisting of the at least one flange of the front wall of the at least one drawer assembly and the at least one flange of the face plate includes an outwardly extending first tab that is received into the gap, thereby coupling the face plate with the front wall of the at least one drawer assembly.

19. The storage cabinet of claim 18, further including:

a locking mechanism operably mounted to the front wall of the at least one drawer assembly and extending outwardly through a front surface of the face plate, the locking mechanism being actuable between a locked position, wherein the locking mechanism prevents the at least one drawer assembly from being removed from the interior of the housing, and an unlocked position, wherein the locking mechanism allows the at least one drawer assembly to be extending from the interior of the housing member.

20. A storage cabinet, comprising:

a housing member including a pair of sidewalls, a rear wall and a bottom wall cooperating to define an interior space and a forwardly facing aperture providing access to the interior space; and at least one drawer assembly operably coupled to the housing member within the aperture for rectilinear movement into and from the interior of the housing member, the at least one drawer assembly comprising:

a bottom wall;

a pair of sidewalls opposed across the bottom wall of the at least one drawer assembly from one another and extending upwardly from the bottom wall of the at least one drawer assembly;

a rear wall extending upwardly from the bottom wall of the at least drawer assembly and between the pair of sidewalls of the at least one drawer assembly;

a front wall extending upwardly from the bottom wall of the at least one drawer assembly between the pair of sidewalls of the at least one drawer assembly and opposed across the bottom wall of the at least one drawer assembly from the rear wall of the at least one drawer assembly, the front wall including at least one laterally extending flange located proximate an uppermost edge thereof; and a face plate having at least one laterally extending flange located substantially proximate an upper edge thereof;

wherein at least a select one of a group consisting of the at least one flange of the front wall of the at least one drawer assembly and of the at least one flange of the face plate includes a pair of flanges defining a first gap therebetween, wherein the at least select one of the at least one flange off the front wall and the at least one flange of the face plate is laterally spaced from an outermost edge of the perspective front wall or face plate, and wherein the remaining one of the group consisting of the at least one flange of the front wall of the at least one drawer assembly and the at least one flange of the face plate includes an outwardly extending first tab that is received into the gap, thereby coupling the face plate with the front wall of the at least one drawer assembly; and wherein at least one flange of the front wall of the at least one drawer assembly includes three upwardly extending flanges cooperating to define the first gap and a second gap therebetween, the face plate includes the first tab and a second tab each extending downwardly, and wherein the first tab is received within the first gap and the second tab is received within the second gap.

21. The storage cabinet of claim 20, wherein the first and second gaps extend inwardly from the at least one flange of the front wall of the at least one drawer assembly.

22. The storage cabinet of claim 21, wherein each tab includes tapered side edges.

23. The storage cabinet of claim 22, wherein the face plate further includes a pair of side tabs extending longitudinally along side edges of the face plate, and wherein the side tabs are secured to the sidewalls of the at least one drawer assembly.

24. The storage cabinet of claim 23, wherein the side tabs of the face plate are located inwardly of the sidewalls.

25. A storage cabinet, comprising:

a housing member including a pair of sidewalls, a rear wall and a bottom wall cooperating to define an interior space and a forward facing aperture providing access to the interior space; and at least one drawer assembly operably coupled to the housing member for rectilinear movement into and from the interior of the housing member, the at least one drawer assembly comprising:

a bottom wall:

a pair of sidewalls opposed across the bottom wall of the at least one drawer assembly from one another and extending upwardly from the bottom wall of the at least one drawer assembly;

a rear wall extending upwardly from the bottom wall of the at least one drawer assembly and between the pair of sidewalls of the at least one drawer assembly;

a front wall extending upwardly from the bottom wall of the at least one drawer assembly and between the pair of sidewalls of the at least one drawer assembly and opposed across the bottom wall of the at least one drawer assembly from the rear wall of the at least one drawer assembly, the front wall including at least one laterally extending flange located proximate an uppermost edge thereof, and forwardly extending tab members located along side edges of the front wall; and a face plate having at least one laterally extending flange located substantially proximate an upper edge thereof, and rearwardly exposed abutment surfaces;

wherein the flange of the front wall of the at least one drawer assembly and the flange of the face plate engage one another, the tab members of the front wall of the at least one drawer assembly engage the abutment surfaces of the face plate, thereby coupling the face plate with the front wall of the at least one drawer assembly, the front wall is adapted to be secured to the pair of sidewalls prior to the face plate being secured to the front wall, the face plate further includes a pair of side tabs extending longitudinally along side edges of the face plate, the side tabs are secured to the sidewalls of the at least one drawer assembly, the side tabs of the face plate are located inwardly of the sidewalls of the at least one drawer assembly, the tab members of the front wall of the at least one drawer assembly are hook-shaped, and wherein the tab members of the front wall of the at least one drawer assembly engage the side tabs of the face plate.

26. The storage cabinet of claim 25, further including:

a locking mechanism operably mounted to the front wall of the at least one drawer assembly and extending outwardly through a front surface of the face plate, the locking mechanism being actuable between a locked position, wherein the locking mechanism prevents the at least one drawer assembly from being removed from the interior of the housing, and an unlocked position, wherein the locking mechanism allows the at least one drawer assembly to be extending from the interior of the housing member.

* * * * *

UNITED STATES PATENT AND TRADEMARK OFFICE

CERTIFICATE OF CORRECTION

PATENT NO. : 7,469,979 B2
APPLICATION NO. : 10/804717
DATED : December 30, 2009
INVENTOR(S) : Tupper et al.

It is certified that error appears in the above-identified patent and that said Letters Patent is hereby corrected as shown below:

Column 6;
Line 64, "is" should be --are--.

Column 8;
Line 14, "slidable" should be --slidably--.

Column 9;
Line 62, "first mounting bracket 22" should be --first mounting bracket 92--.

Column 15;
Line 22, "Figs." should be --Fig.--.
Line 67, "an" should be --and--.

Column 16;
Line 6, "are" should be --is--.
Claim 1 Line 37, "perspective" should be --respective--.

Column 18;
Claim 16 Line 29, "place" should be --plate--.
Claim 18 Lines 53-54, "of the at least drawer" should be --of the at least one drawer--.

Column 19;
Claim 18 Line 8, "is" should be --are--.
Claim 18 Line 9, "perspective" should be --respective--.
Claim 20 Lines 42-43, "of the at least drawer" should be --of the at least one drawer--.
Claim 20 Line 61, "off" should be --of--.
Claim 20 Line 63, "perspective" should be --respective--.

Column 20;
Claim 25 Line 26, "forward" should be --forwardly--.

Signed and Sealed this

Twenty-fifth Day of May, 2010

David J. Kappos

David J. Kappos
*Director of the United States Patent and Trademark Office*